US010124244B2

(12) United States Patent
Bellamy

(10) Patent No.: US 10,124,244 B2
(45) Date of Patent: Nov. 13, 2018

(54) APPARATUS FOR ANIMATED BEER PONG (BEIRUT) GAME

(71) Applicant: Adam Bellamy, Aurora, OH (US)

(72) Inventor: Adam Bellamy, Aurora, OH (US)

( * ) Notice: Subject to any disclaimer, the term of this patent is extended or adjusted under 35 U.S.C. 154(b) by 0 days.

(21) Appl. No.: 15/404,624

(22) Filed: Jan. 12, 2017

(65) Prior Publication Data

US 2017/0197141 A1 Jul. 13, 2017

Related U.S. Application Data

(60) Provisional application No. 62/277,770, filed on Jan. 12, 2016.

(51) Int. Cl.

| | |
|---|---|
| ***A63F 7/30*** | (2006.01) |
| ***A63B 63/08*** | (2006.01) |
| ***A63B 67/06*** | (2006.01) |
| ***A63F 7/00*** | (2006.01) |
| ***A63B 71/06*** | (2006.01) |

(52) U.S. Cl.

CPC ..... *A63F 7/30* (2013.01); *A63B 63/08* (2013.01); *A63B 67/06* (2013.01); *A63B 71/0622* (2013.01); *A63F 7/0017* (2013.01); *A63F 7/0058* (2013.01); *A63B 2071/0625* (2013.01); *A63B 2207/02* (2013.01); *A63B 2209/08* (2013.01); *A63B 2225/10* (2013.01); *A63B 2225/20* (2013.01); *A63B 2225/50* (2013.01); *A63F 2007/303* (2013.01); *A63F 2250/024* (2013.01)

(58) Field of Classification Search

CPC ..... A63F 7/30; A63F 7/0017; A63F 7/0058; A63B 63/08; A63B 67/06

See application file for complete search history.

(56) References Cited

U.S. PATENT DOCUMENTS

| | | | | |
|---|---|---|---|---|
| 6,189,885 | B1 * | 2/2001 | Hamot | A63F 7/068 273/108.1 |
| 8,028,995 | B2 | 10/2011 | Hoffer | |
| 8,205,887 | B2 | 6/2012 | Wyland | |
| 8,282,457 | B1 | 10/2012 | Edwards | |

(Continued)

FOREIGN PATENT DOCUMENTS

WO 2011105983 A1 9/2011

*Primary Examiner* — Michael Dennis

(74) *Attorney, Agent, or Firm* — Renner Kenner Greive Bobak Taylor & Weber

(57) ABSTRACT

The present invention provides an animated game table for playing games such as Beer Pong (Beruit), that permits individual or group cup movement across a low-friction game surface via magnetic attraction. In one or more embodiments, the animated game table of the present invention utilizes a series of animated magnets placed below the surface of a low-friction game surface to move an one or more magnetically sensitive cups across the top of the low-friction game surface. In some embodiments, the movement of these magnets, and therefore the cups, is controlled by a microprocessor and various movement patterns can be preprogrammed or controlled through a wireless connection to a smart phone or other similar device. In some embodiments, flashing lights and speakers, also controlled by the microprocessor, can be added to increase the excitement and/or difficulty of the game and improve the overall gameplay experience.

23 Claims, 17 Drawing Sheets

(56) References Cited

U.S. PATENT DOCUMENTS

| | | | | |
|---|---|---|---|---|
| 2010/0178982 | A1* | 7/2010 | Ehrman | A63F 7/0664 463/37 |
| 2010/0244384 | A1* | 9/2010 | Hoffer | A63B 67/06 273/342 |
| 2015/0137452 | A1* | 5/2015 | Dahl | A63F 7/0017 273/342 |

* cited by examiner

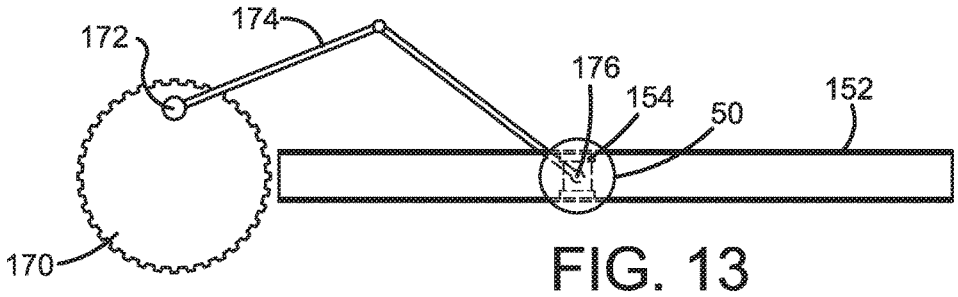
FIG. 13
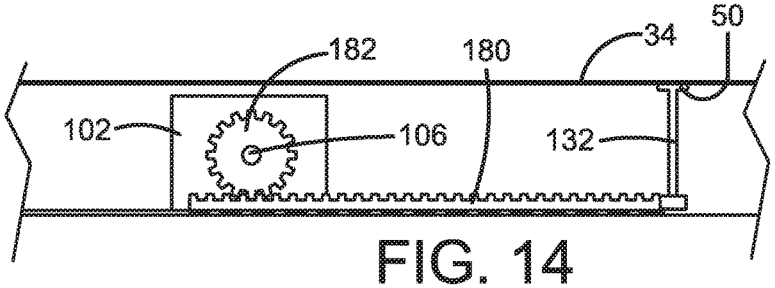
FIG. 14
FIG. 15A
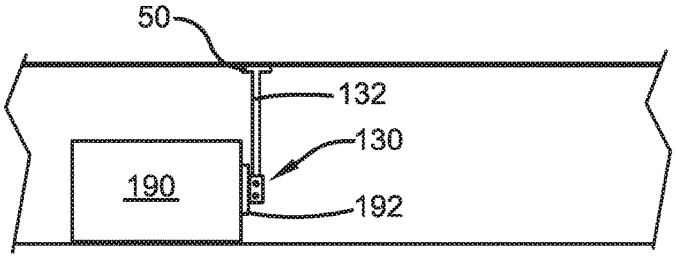
FIG. 15B
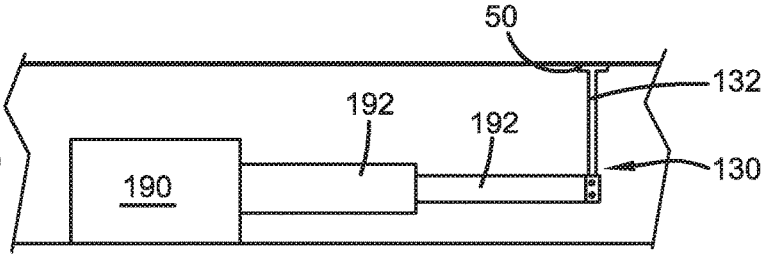
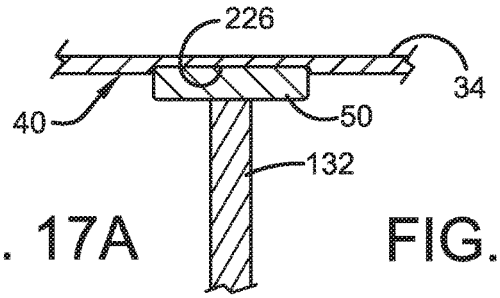
FIG. 17A
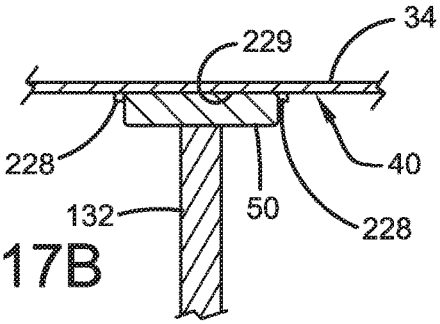
FIG. 17B

APPARATUS FOR ANIMATED BEER PONG (BEIRUT) GAME

CROSS REFERENCE TO RELATED APPLICATIONS

This application claims the benefit of U.S. provisional patent application Ser. No. 62/277,770 entitled "Animated Beer Pong (Beirut) Game," filed Jan. 12, 2016 and incorporated herein by reference in its entirety.

FIELD OF THE INVENTION

One or more embodiments of the present invention relates to an animated game apparatus. In certain embodiments, the present invention relates to an animated apparatus for playing drinking games.

BACKGROUND OF THE INVENTION

Social drinking games have been in existence since the introduction of alcoholic beverages, with the purpose of reducing participants' boredom through entertainment. For decades, one of the most popular drinking games continues to be Beer Pong (also known as Beirut).

While there are many variations, the game generally features two clusters of cups set at opposite ends of a table, usually a ping pong table. The cluster of cups can be arranged in any order, but the most typical arrangement is in the shape of a triangle with the upper rims of the cups touching one another. A beverage, usually beer, is poured into each cup to keep it from sliding or falling over. Two teams at each end of the table stand behind their cluster of cups, and throw balls (or strike them with a table tennis paddle) across the table at the opposing team's cluster of cups. When a team member lands a ball into the opposing team's cup, a member on the opposing team must remove that cup from their cluster and drink the beverage inside or pay some other penalty. The cup is then discarded from the original cluster. The first team to eliminate all of the cups from the opposing team's cluster of cups wins the game.

To make the game more interesting and increase the level of difficulty dedicated game table have been developed and various mechanisms for moving the cluster of cups have been developed. In some of these devices, the cluster of cups is placed in a tray with cup holder slots and a perimeter wall and moved together as a group. In one such example, the cup holder tray spins the cluster of cups around on a fixed axis. In another such example, the cup holder tray slides back and forth on a track that is custom built into the table. In other devices, a magnetic platform used to keep the cups in place.

All of these systems keep all of the cups bunched together in one place and do not significantly change the nature or difficulty of the game. Moreover, in some of these systems the mechanism for moving the cup tray are open to the outside and may become wet with the beverage (generally beer) being used for the game or spilled on the table by the participants. These mechanisms can become fouled in this manner and may be difficult to clean.

What is needed in the art is an animated apparatus for playing games like beer pong where the cups are animated to move individually, rather than bunched together in a group, and where the mechanism for moving the cups is protected from being fouled by spilled beverages.

SUMMARY OF THE INVENTION

In one or more embodiments, the present invention provide an animated game table for playing games such as beer pong, that permits individual or group cup movement across a flat low-friction game surface via magnetic attraction. In one or more embodiments, the animated game table of the present invention utilizes a series of animated magnets placed below the surface of a low-friction game surface to move an individual cup or groups of having a corresponding magnet or ferrous metal at or near their base across the top of the low-friction game surface. In some embodiments, the movement of these magnets, and therefore the cups, are controlled by a microprocessor and various movement patterns can be preprogrammed or in other embodiments, the movement of the magnets may be controlled through a wireless connection to a smart phone or other similar device. In some embodiments, flashing lights and speakers, also controlled by the microprocessor, can be added to increase the excitement and/or difficulty of the game and improve the overall gameplay experience. Moreover, as the magnetic forces used to move the cups act through the low-friction game surface, no openings are necessary and the various mechanisms for moving the magnets (and thereby the cups) are protected from spilled fluids, such as beer, preventing fouling of these mechanisms and the need for regular and difficult cleaning operations.

In a first aspect, the present invention is directed to an animated game table comprising: a game table top having an upper surface and a lower surface; one or more cups arranged on the top surface of the game table top, each cup comprising a magnet or ferrous metal; one or more mover magnets in contact with or in close proximity to the lower surface of the game table top; wherein each of the one or more cups is magnetically attracted to one of the one or more mover magnets, so that movement of the one or more mover magnets along the lower surface of the game table top will cause the cups magnetically attracted thereto to move along the upper surface of the game table top with the movement of the one or more mover magnets; a mechanism for moving the one or more mover magnets along the lower surface of the game table top; and a microprocessor controllably connected to the mechanism for controlling the movement of the plurality of mover magnets. In some embodiments, the animated game table further comprises a lower surface located below and separated from the game table top to which at least some of the mechanism for moving the mover magnets is mounted.

In one or more embodiments, the animated game table of the present invention includes any one or more of the above referenced embodiments of the first aspect of the present invention wherein the mechanism for moving the mover magnets further comprises: a motor operably connected to a drive gear so that the motor causes the drive gear to turn; one or more gears operatively connected with the drive gear or each other so that the one or more gears all rotate as the drive gear is turned by the motor; a first pulley or cog mounted on or engaged with one of the one or more gears so that it rotates with the rotation of the one or more gears; a second pulley or cog; a belt or chain running between the first pulley or cog and the second pulley or cog; and a bracket mounted on the belt or chain and connected to one of the mover magnets, the bracket being configured to keep the mover magnet in contact with or in close proximity to the lower surface of the game table top as the belt or chain rotates around the first pulley or cog and the second pulley or cog to move the mover magnet.

In one or more embodiments, the animated game table of the present invention includes any one or more of the above referenced embodiments of the first aspect of the present invention wherein the mechanism for moving the mover magnets further comprises: one or more electric motors each operatively connected to a first pulley or cog so that the first pulley or cog rotates with the rotation of the electric motor; a second pulley or cog; a belt or chain running between the first pulley or cog and the second pulley or cog; and a bracket mounted on the belt or chain and connected to one of the mover magnets, the bracket being configured to keep the mover magnet in contact with or in close proximity to the lower surface of the game table top as the belt or chain rotates around the first pulley or cog and the second pulley or cog to move the mover magnet.

In one or more embodiments, the animated game table of the present invention includes any one or more of the above referenced embodiments of the first aspect of the present invention wherein the mechanism for moving the mover magnets further comprises: a track; a trolley configured to move along the track; a bracket mounted on the trolley configured to keep the mover magnet in contact with or in close proximity to the lower surface of the game table top as the trolley moves along the track; and a motor for moving the trolley back and forth along the track. In one or more embodiments, the animated game table of the present invention includes any one or more of the above referenced embodiments of the first aspect of the present invention wherein the track is a groove cut into the lower surface. In one or more embodiments, the animated game table of the present invention includes any one or more of the above referenced embodiments of the first aspect of the present invention wherein the motor moves the trolley back and forth along the track by means of a pulley, a chain, a cam, a screw, or a piston.

In one or more embodiments, the animated game table of the present invention includes any one or more of the above referenced embodiments of the first aspect of the present invention wherein the mechanism for moving the mover magnets further comprises: a robotic arm configured to move one or more of the mover magnets along the lower surface of the game table top.

In one or more embodiments, the animated game table of the present invention includes any one or more of the above referenced embodiments of the first aspect of the present invention wherein the mechanism for moving the mover magnets further comprises: a wirelessly controlled motorized trolley, wherein the movement of the wirelessly controlled motorized trolley is controlled by the microcontroller; and a bracket mounted on the trolley configured to keep the mover magnet in contact with or in close proximity to the lower surface of the game table top as the trolley moves along the track. In one or more embodiments, the animated game table of the present invention includes any one or more of the above referenced embodiments of the first aspect of the present invention wherein the animated game table further comprises a induced magnetism charge generating pad connected to a power source and the trolley further comprises an induced magnetism charger connected to a rechargeable battery, wherein the rechargeable battery of the trolley can be charged by placing the trolley on the induced magnetism charge generating pad.

In one or more embodiments, the animated game table of the present invention includes any one or more of the above referenced embodiments of the first aspect of the present invention wherein each trolley further comprises one or more proximity sensors for determining the location of the induced magnetism charge generating pad. In one or more embodiments, the animated game table of the present invention includes any one or more of the above referenced embodiments of the first aspect of the present invention further comprising one or more proximity sensors for determining whether the one or more mover magnets are in a first position.

In one or more embodiments, the animated game table of the present invention includes any one or more of the above referenced embodiments of the first aspect of the present invention further comprising one or more colored or flashing lights, wherein the operation of the one or more colored or flashing lights is controlled by the microprocessor. In one or more embodiments, the animated game table of the present invention includes any one or more of the above referenced embodiments of the first aspect of the present invention further comprising one or more speakers, wherein the operation of the speakers is controlled by the microprocessor. In one or more embodiments, the animated game table of the present invention includes any one or more of the above referenced embodiments of the first aspect of the present invention wherein the microprocessor controls the movement of the mover magnets and the operation of the one or more colored or flashing lights and the one or more speakers based upon instructions stored in memory accessible to the microcontroller.

In one or more embodiments, the animated game table of the present invention includes any one or more of the above referenced embodiments of the first aspect of the present invention wherein the microcontroller is wirelessly linked to a smart device and controls the movement of the mover magnets and the operation of the one or more colored or flashing lights and the one or more speakers based upon instructions received from the smart device.

In a second aspect, the present invention is directed to an animated game table system comprising two or more or the animated game tables described above controllably connected and/or networked together. In one or more embodiments of this aspect of the present invention the two or more animated game tables are also networked with and controlled by a smart device.

In a third aspect, the present invention is directed to method of moving a magnetically sensitive cup along a game table surface using the animated game table of described above in the first aspect of the present invention comprising: providing a game table top having a low friction upper surface and a lower surface; placing a mover magnet against or in close proximity to the power surface of the game table top; placing a magnetically sensitive cup on the low friction upper surface of the game table top directly above the mover magnet, such that a magnetic attraction is formed between the magnetically sensitive cup and the mover magnet; and moving the mover magnet along the lower surface so that the magnetically sensitive cup is pulled along the low friction upper surface of the game table top by the magnetic attraction between the magnetically sensitive cup and the mover magnet. In one or more of these embodiments, the mover magnets may be moved using any of the mechanisms described above with respect to the first aspect of the present invention.

BRIEF DESCRIPTION OF THE DRAWINGS

For a more complete understanding of the features and advantages of the present invention, reference is now made to the detailed description of the invention along with the accompanying figures in which:

FIG. 13 is a top view of a gear and two-piece bar based mechanism for moving a magnet bearing trolley along a track (or groove) secured to the floor of the game base of an animated game table according to one or more embodiments of the present invention;

FIG. 14 is side view of a rack and pinion gear based mechanism for moving a magnet along the bottom surface of the low friction game table according to one or more embodiments of the present invention;

FIGS. 15A-B are side elevational views of a piston based mechanism for moving a magnet along the bottom surface of the low friction game table according to one or more embodiments of the present invention showing the piston contracted (FIG. 15A) and the piston extended (FIG. 15B);

FIGS. 17A-B are partial cross sectional views showing a groove (FIG. 17A) and ridges (FIG. 17B) for guiding a magnet along the bottom surface of the low friction game table according to one or more embodiments of the present invention.

DETAILED DESCRIPTION OF THE ILLUSTRATIVE EMBODIMENTS

In various embodiments, the present invention is directed to an animated game table for playing games such as beer pong, that permits individual or group cup movement across a flat low-friction game surface via magnetic attraction. In one or more embodiments, the animated game table of the present invention utilizes a series of animated magnets placed below the surface of a low-friction game surface to move an individual cup or groups of having a corresponding magnet or ferrous metal at or near their base across the top of the low-friction game surface. As the magnetic forces used to move the cups act through the low-friction game surface, no openings are necessary and the various mechanisms for moving the magnets (and thereby the cups) are protected from spilled fluids, such as beer, preventing fouling of these mechanisms and the need for regular and difficult cleaning operations.

Figure 1:
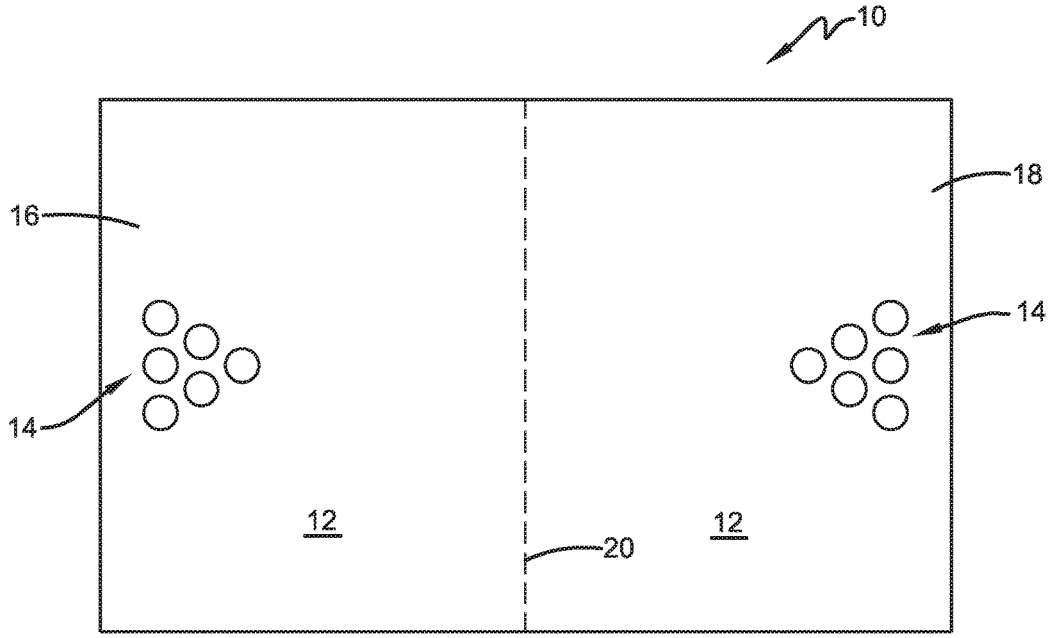
FIG. 1 PRIOR ART
FIG. 1 is a top plan view of a prior art game table used to play Beer Pong (Beirut)

Referring now to FIG. 1, a typical game table for playing beer pong is shown, generally indicated by the numeral 10. Typical game table 10 includes a game table surface 12 and two grouping of cups 14 located at a first and second end 16,18 of table surface 12, and in some cases a net 20. As set forth above, a beverage, usually beer, is poured into each cup 14 to keep it from sliding or falling over. Two teams at each end of the table stand behind their cluster of cups, and throw balls (or hit them with a table tennis paddle) across the table at the opposing team's cluster of cups. When a team member lands a ball into the opposing team's cup, a member on the opposing team must remove that cup from their cluster and drink the beverage inside or pay some other penalty. The cup is then discarded from the original cluster. The first team to eliminate all of the cups from the opposing team's cluster of cups wins the game.

Figure 3:
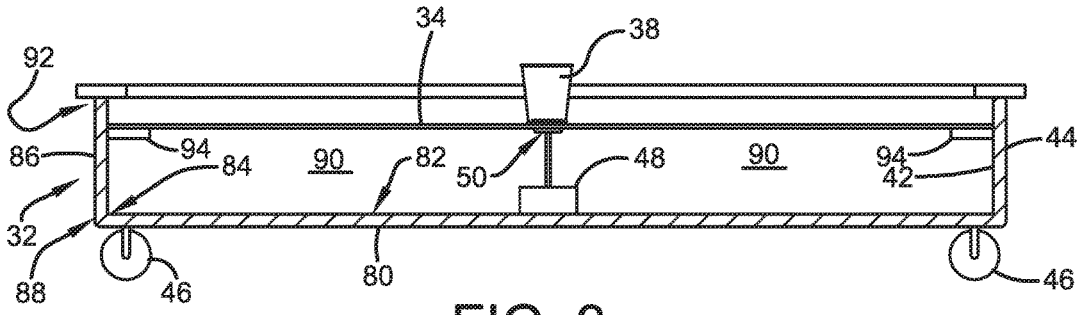
FIG. 3 is a cross sectional view of an animated game table according to one or more embodiments of the present invention.
Figure 2A:
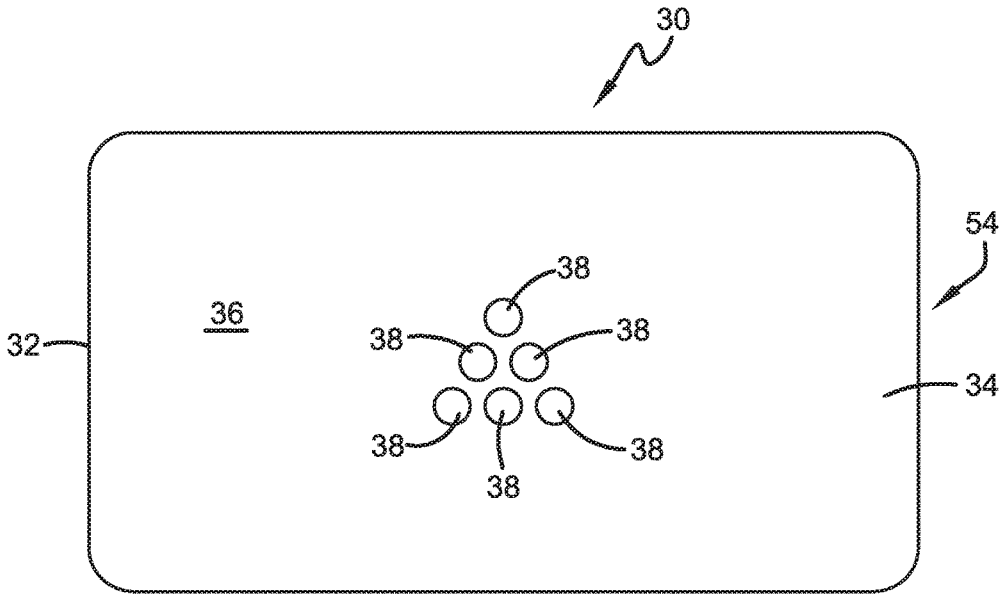
FIGS. 2A-B are top plan views of an animated game table according to one or more embodiments of the present invention showing the magnetically sensitive cups in a starting (first) position (FIG. 2A) and a second position (FIG. 2B)
Figure 2B:
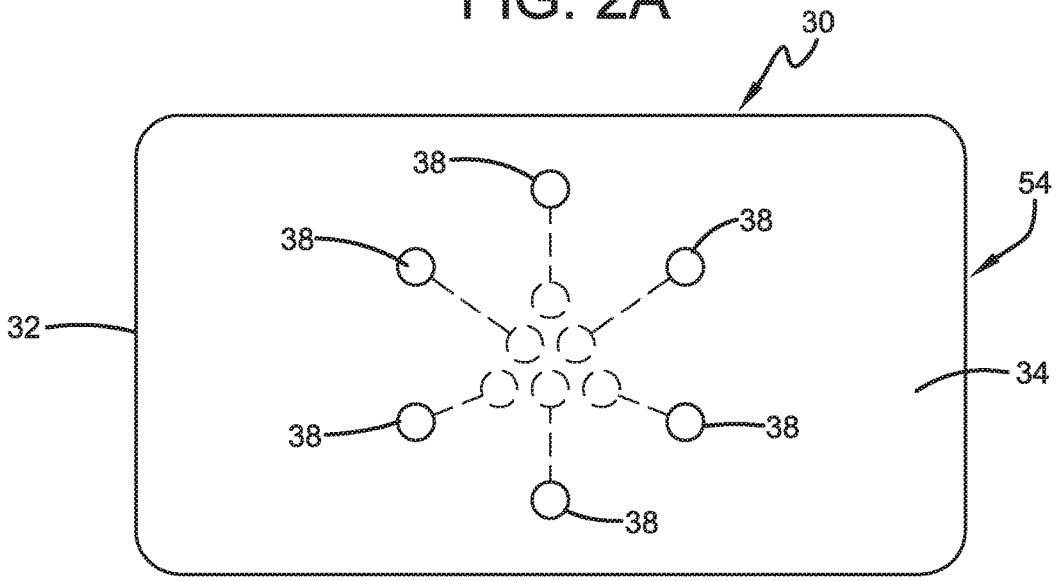

As can be seen in FIGS. 2A and B, in one or more embodiments, the animated game table 30 of the present invention permits movement of the individual cups, causing them to separate and increasing the difficulty of the gameplay. In one or more embodiments, animated game table 30 comprises a base 32 and a low friction game table top 34, having an upper surface 36 upon which a series of magnetically sensitive cups 38 sit and a lower surface 40. (See FIGS. 2A, 2B, and 3) As can be seen in the embodiment of FIG. 3, base 32 has an internal surface or floor 42, an outside or external surface 44 to which 3 or more of wheels or legs 46 may be attached. As can be seen, base 32 houses one or more mechanisms 48 for moving one or more mover magnets 50 along the lower surface 40 of low friction game table top 34. Mover magnets 48 generate a magnetic field 52 that passes through the low friction game table top 42 and interacts with the magnetically sensitive cups 38, such that when a mover magnet 50 interacting with a magnetically sensitive cup 38 is moved along the lower surface 40 of low friction game table top 34, the magnetically sensitive cup 38 moves along the upper surface 36 of low friction game table top 34 with it.

In some embodiments, the animated game table 30 of the present invention may be configured in a manner similar to the typical game table shown in FIG. 1, with a single low friction game table top 34 having a grouping of magnetically sensitive cups 38 and mechanisms 48 for moving them on each end of the table. In some of these embodiments, animated game table 30 is free standing table having a conventional set of table legs or pedestal(s) (not shown) for support.

In some other embodiments, the animated game table 30 of the present invention is comprised of two separate game units 54, each having a set of magnetically sensitive cups 38 and mechanism(s) 58 for moving them, that are physically and/or electronically joined for game play. In some embodiments, the two game units are not physically joined, but simply placed end to end to allow game play. The two game units may, in other embodiments, be releasably joined in any manner known in the art for that purpose, including, without limitation, hooks, tabs, or pins. In some other embodiments, a single game unit 54 having a set of magnetically sensitive cups 38 and mechanism(s) 48 for moving them may be used.

The dimensions of the low friction game table top 34 is not particularly limited and may vary with the size of the magnetically sensitive cups 38 and ball being used, as well as the desired style of play. The ball (not shown) is preferably a standard table tennis ball, but the invention is not so limited and any ball sized to fit into magnetically sensitive cups 38 without regularly knocking them over may be used in certain embodiments.

In embodiments the animated game table 30 of the present invention where there is a single low friction game table top 34 having a set of magnetically sensitive cups 38 and mechanism(s) 48 for moving them on each end of the table as described above, the low friction game table top 34 may have an end to end length of from about 3 feet to about 10 feet and a width of from about 2 feet to about 6 feet. In some embodiments, the low friction game table top 34 may have an end to end length of from about 3 feet to about 9 feet, in other embodiments, from about 3 feet to about 7 feet, in other embodiments, from about 4 feet to about 10 feet, in other embodiments, from about 5 feet to about 10 feet, in other embodiments, from about 6 feet to about 10 feet, in other embodiments, from about 4 feet to about 8 feet, in other embodiments, from about 4 feet to about 7 feet and in other embodiments, from about 5 feet to about 7 feet. In some embodiments, the low friction game table top 34 may have a width of from about 2 feet to about 5 feet, in other embodiments, from about 2 feet to about 4 feet, in other embodiments, from about 3 feet to about 6 feet, in other embodiments, from about 3 feet to about 5 feet, and in other embodiments, from about 4 feet to about 6 feet. Here, as well as elsewhere in the specification and claims, individual range values can be combined to form additional non-disclosed ranges.

In embodiments having one or two game units 54 as described above, the low friction game table top 34 for each unit 54 may have a length of from about 5 inches to about 5 feet and a width of from about 5 inches to about 5 feet. In some of these embodiments, the low friction game table top 34 may have a length of from about 1 foot to about 5 feet, in other embodiments, from about 2 feet to about 5 , in other embodiments, from about 1 foot to about 4 feet, in other embodiments, from about 1 foot to about 3 feet, and in other embodiments, from about 2 feet to about 4 feet. In some embodiments, the low friction game table top 34 may have a width of from about 1 foot to about 5 feet, in other embodiments, from about 2 feet to about 5 , in other embodiments, from about 1 foot to about 4 feet, in other embodiments, from about 1 foot to about 3 feet, and in other embodiments, from about 2 feet to about 4 feet. Here, as well as elsewhere in the specification and claims, individual range values can be combined to form additional non-disclosed ranges.

As set forth above, low friction game table top 34 has an upper surface 36 upon which a series of magnetically sensitive cups 38 sit and a lower surface 40. The low friction game table top 34 is preferably rigid and can be made from any non-magnetic material, provided that the material chosen does not block the magnetic attraction between mover magnets 50 and magnetically sensitive cups 38 in such a way as to prevent the mover magnets from moving the magnetically sensitive cups 38. Low friction game table top 34 may be made from a single material or as a composite of two or more materials. In some embodiments, a thin layer of low friction game table top is supported by a thin platform of more rigid and less expensive material. These configurations permit the use of materials having good or excellent low friction properties but either lack the required strength (at any thickness) or are prohibitively expensive at the thicknesses that would be necessary for them to have the required strength. Suitable materials to use as a support platform (not shown) may include without limitation, polystyrene, acrylonitrile butadiene styrene (ABS), polycarbonate, acrylic, aluminum, foam core board, and wood. Suitable materials to use for upper surface 36 may include, without limitation, plastics, glass, acetal (POM), nylon (PA), polyphthalamide (PPA), polyetheretherketone (PEEK), polyphenylene sulfide (PPS), polybutylene terephthalate (PBT), thermoplastic polyimide (TPI), polycarbonate (PC), polyetherimide (PEI), polyvinyl chloride (PVC), high density polyethylene (HDPE), and ultra-high molecular weight plastics. In one or more embodiments, upper surface 36 may be made from high density polyethylene (HDPE). In some other embodiment, low friction game table top 34 may be composed of high density polyethylene (HDPE) (upper surface) and acrylonitrile butadiene styrene (ABS) (support platform).

In one or more embodiments, upper surface of low friction game table top 34 may have a coefficient of friction of less than 0.02, in other embodiments, less than 0.01, in other embodiments, less than 0.03, in other embodiments, less than 0.04, in other embodiments, less than 0.05, and in other embodiments, less than 0.7.

The thickness of the low friction game table top 34 will depend upon strength of mover magnet 50, the characteristics of the material used to make it, and its dimensions, among other factors. On one hand, it must at a minimum be thick enough to have the strength necessary support its own weight without significant sagging or breaking, support the weight of the magnetically sensitive cups 38, and absorb impacts from the ball to be used during gameplay. That being said, the thinner the low friction game table top 34 is, the less magnetic force is required for the mover magnets 50 to move the magnetically sensitive cups 38. On the other hand, while a thicker low friction game table top 34 will be stronger, it will be appreciated that as the low friction game table top 34 becomes thicker, it becomes heavier and the distance between mover magnets 50 and magnetically sensitive cups 38 increases, reducing the strength of the magnetic attraction between them, necessitating the use of stronger, heavier, and more expensive mover magnets 50.

One of ordinary skill in the art will be able to determine an optimal thickness of the low friction game table top 34 for a given material and mover magnet 50 strength, without undue experimentation. In some embodiments, the low friction game table top 34 may have a thickness of from about 0.0625 inch to 0.125 inch, in other embodiments, from about 0.125 inch to 0.1875 inch, in other embodiments, from about 0.1875 inch to 0.25 inch, in other embodiments, from about 0.25 inch to 0.3125 inch, in other embodiments, from about 0.3125 inch to 0.375 inch, in other embodiments, from about 0.375 inch to 0.4375 inch, and in other embodiments, from about 0.4375 inch to 0.5 inch. In some embodiments, the low friction game table top 34 may be made from high-density polyethylene (HDPE) and have a thickness of from about 0.125 inch to 0.1875 inch. In some embodiments, the low friction game table top 34 may be made from high density polyethylene (HDPE) and have a thickness of from about 1.3 mm to 4 mm. Here, as well as elsewhere in the specification and claims, individual range values can be combined to form additional non-disclosed ranges.

Upper surface 36 of low friction game table top 34 is preferably optimized to reduce the friction between it and the magnetically sensitive cups 38 in order to facilitate easy movement of the magnetically sensitive cups 38 as they are pulled by the movement of mover magnets 50. As will be apparent, the less friction there is between magnetically sensitive cups 38 and upper surface 36, the less magnetic force will be required to move the magnetically sensitive cups 38, allowing for the use of a smaller, less powerful, mover magnet(s) 50. Conversely, the more friction there is between magnetically sensitive cups 38 and upper surface 36, the stronger mover magnet 50 must be to move magnetically sensitive cups 38, and if the friction forces are too great it may become impossible for the magnetically sensitive cups 38 to slide along the upper surface 36 of low friction game table top 34 at all. Numerous low friction surfaces and methods for reducing friction on a flat surface are known in the art and may be used with various embodiments of the present invention, including, without limitation, smoothing and polishing, low friction textured surfaces, such as high density polyethylene (HDPE), low friction surface coatings or lubricants, such as Teflon™, silicone, mineral oil, polyalphaolefin (PAO), perfluoropolyether (PFPE), graphite, and high-density waxes. In one or more embodiments, air may be forced through small holes or perforations in low friction game table top 34 in a manner common to air hockey game tables (including fans and air pumps), to reduce friction between magnetically sensitive cups 38 and upper surface 36 of low friction game table top 34.

Figure 4:
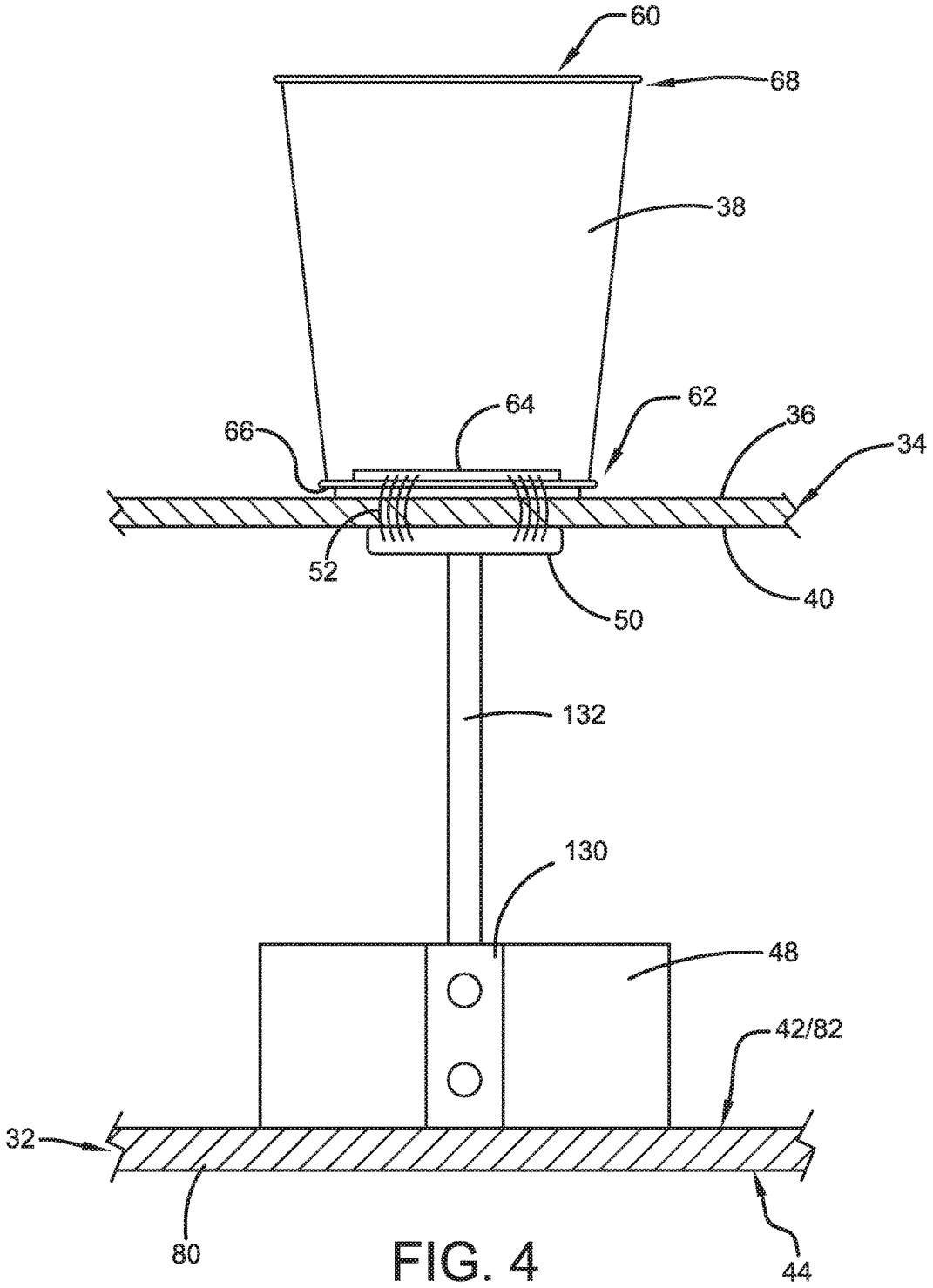
FIG. 4 is a partial cross sectional view of an animated game table according to one or more embodiments of the present invention as shown in FIG. 3 further illustrating the relationship between the magnetically sensitive cup, low friction game table top, the mover magnet and the mechanism for moving the mover magnet.
Figure 5:
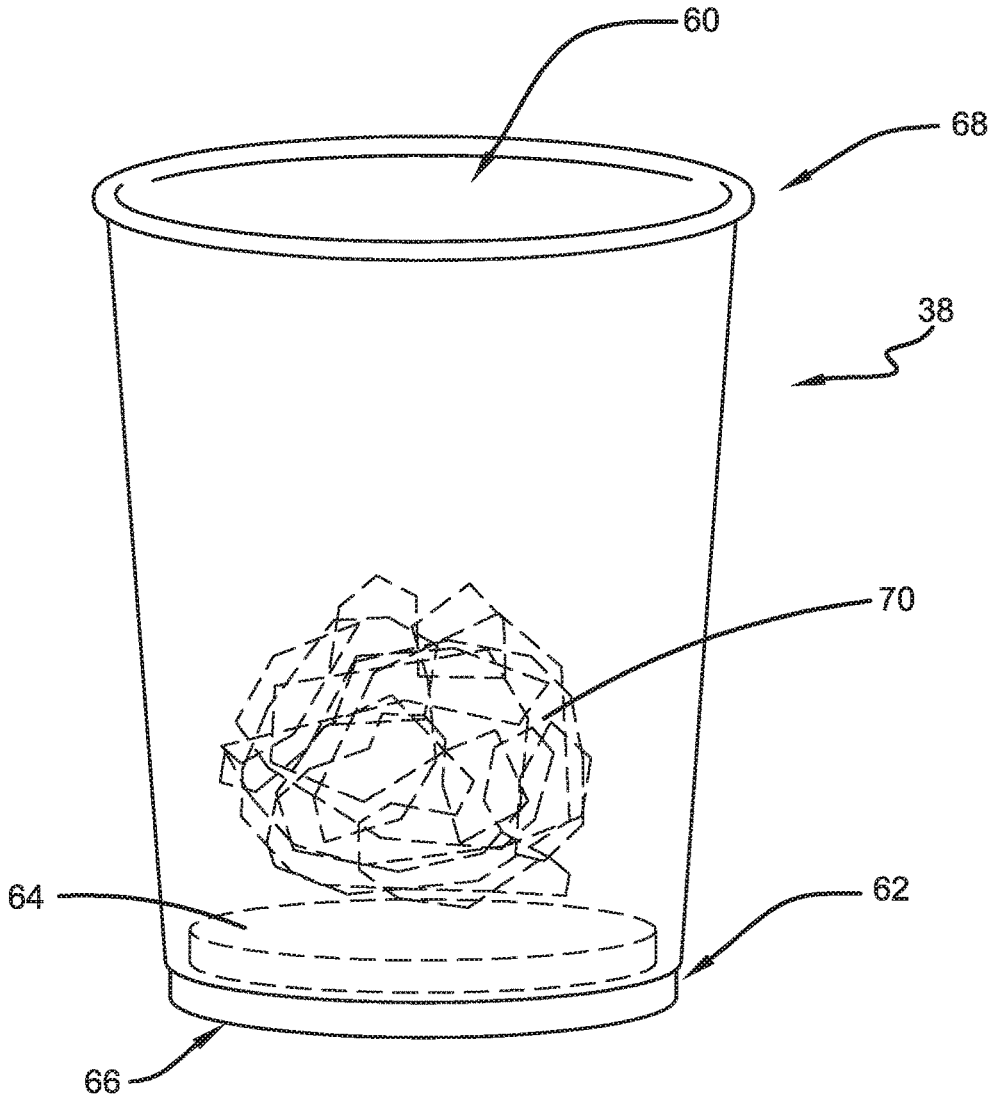
FIG. 5 is a perspective view of a magnetically sensitive cup according to one or more embodiments of the present invention.

Turning to FIGS. 4 and 5, magnetically sensitive cups 38 have an open top end 60 and a base 62. And as should be apparent, each of the magnetically sensitive cups 38 has a magnetic object 64 at or near its base 62 that can form magnetic attraction with the mover magnet. Magnetic object 64 can be either a ferrous or other magnetically active metal or a magnet, but if a magnet is used care must be taken to make sure that the magnet is oriented so its positive magnetic pole is facing the negative magnetic pole of the mover magnet or its negative magnetic pole is facing the positive magnetic pole of the mover magnet, so that magnetic material 64 is attracted to the mover magnet, rather than repelled from it.

In one or more embodiments, magnetically sensitive cups 38 may further comprise one or more friction reducing pads 66 to further reduce the friction between the magnetically sensitive cups 38 and upper surface 36 of low friction game table top 36. (FIG. 4) Suitable materials to use as friction reducing pads may include, without limitation, fibrous felt, ultra-high molecular weight plastics, acetal, nylon, polyphthalamide, polyetheretherketone, polyphenylene sulfide, polybutylene terephthalate, thermoplastic polyimide, polycarbonate, polyetherimide, and high-density Polyethylene. The friction reducing pads may be attached to the bottom of the cups via an adhesive or mechanical fastener. Suitable adhesives may include, without limitation, chemically bonding agents, glue, epoxy, and double sided adhesive tape.

The shape of magnetically sensitive cups 38 is not particularly limited provided it has a top end 68 with an opening 60 large enough to allow the ball to enter and is stable enough that it can be pulled along the upper surface 36 of low friction game table top 34 without tipping over. In various embodiments, magnetically sensitive cups 38 may have a circular, oval, square, rectangular, triangular, or polygonal cross section. In some embodiments, all of the magnetically sensitive cups 38 are identical, but this need not be the case and embodiments where the magnetically sensitive cups 38 are different sizes and shapes are possible and within the scope of the present invention.

Turning again to FIG. 5, magnetically sensitive cups 38 may further comprise cushioning material 70 placed in the lower portion of each cup to help prevent the ball from bouncing out of the cup. Traditionally, liquid is poured into to cups to hold them in place and prevent the ball from bouncing out, but the magnetic attraction between the cups and the base eliminates the need for the added weight of the liquid. However, a material that will absorb the momentum of the ball when it lands inside the cup must replace the liquid that is usually inside the cup. Cushioning material 70 is not particularly limited and may include, without limitation, cotton, foam, styrofoam, memory foam, sorbathane, gelatin, rubberized fiber cushioning, bubble films, rubber, gum, flexible plastic foams, polystyrene, polyurethane, polyethylene, hair, fur, wool, and micro-fibers.

As set forth above, low friction game table top 34 is supported by a base 32, which houses the mover magnets 50 and various mechanisms 48 for moving them. Turning again to FIG. 3, base 32 comprises a bottom portion 80 having an upper/floor surface 82 upon which mechanisms 50 and other components are mounted and/or supported and a perimeter edge 84. Each of the side walls 86 has a lower edge 88 that is joined to perimeter edge 84 of bottom 80 to define a cavity 90 in which mechanisms 50 and other components may be housed. Low friction game table top 34 is mounted to base 32 at or near upper edge 92 of the side walls 86 of base 32 may be secured there in any manner known in the art for that purpose, but is preferably removable to permit cleaning and maintenance of mechanisms 50 and other components housed therein. By way of example, low friction game table top 34 may be supported by a base 32 by means of a series of brackets 94 mounted at various points around cavity 90, at or near upper edge 92 of side walls 86 of base 32, spaced so as to support the weight of the low friction game table top 34. In some other embodiments, low friction game table top 34 is supported by a base 32 by means of one or more hinges (not shown) and one or more brackets 94 mounted within cavity 90, at or near upper edge 92 of side walls 86 of base 32. In some other embodiments, upper edge 92 of at least two side walls 86 further comprise a rabbit or groove (not shown) configured to receive low friction game table top 34. In yet other embodiments, low friction game table top 34 is larger than base 32 and is simply placed on top of base 32. In these embodiments, low friction game table top 34 may be secured to base 32 any one of countless methods known in the art for doing so including, but not limited to brackets, hinges, clips, snaps, screws, slots, tabs, and/or magnets.

As set forth above, the animated game table 30 of the present invention further comprises a plurality of mover magnets 50 and mechanisms 48 for moving these mover magnets 50 to cause the magnetically sensitive cups 38 to move along upper surface 36 of low friction game table top 34. The size and magnetic strength of mover magnets 50 will depend upon such factors as the thickness of the low friction game table top 34, the materials used to form the low friction game table top 34, the coefficient of friction of the upper surface 36 of low friction game table top 34, and the magnetic properties of the magnetic object 64 at or near the base 62 of the magnetically sensitive cups 38. Mover magnets 50 should be strong enough to generate the magnetic forces necessary to move the magnetically sensitive cups 38 along upper surface 36 of low friction game table top 34 as the mover magnet 50 is moved by magnet moving mechanism 48, but not so strong that the magnetic force between mover magnets 50 and the magnetic objects 64 pulls magnetically sensitive cups 38 against the upper surface 36 of low friction game table top 34 with so much force that it becomes difficult for to move them with mover magnets 50.

Mover magnets 50 are preferably permanent magnets and can be made from any magnetizable material, including, but not limited to, iron, rare earth metals, ceramics, strontium-iron, ferrite, neodymium, neodymium-iron-boron alloys, samarium-cobalt alloys, aluminum-nickel-cobalt alloys (Alnico), or a combination thereof. In one or more embodiments, electromagnets may be used as mover magnets 50, as an alternative to permanent magnets. In one or more embodiments, the magnetic field created by mover magnet 50 acts on magnetic object 64 through low friction game table top 34 with a pull force of from about 0.3 pounds to about 5.0 pounds and is preferably from about of 0.5 pounds to 3.0 pounds. As used herein, the "pull force" refers to the amount of force necessary to pull magnetic object 64 and/or magnetically sensitive cup 38 away from the upper surface 36 of low friction game table top 34 and may be measured by any conventional means including, but not limited to, a pull scale or tensometer. In some embodiments, the pull force may also be calculated entering the following factors into a mathematical equation that is designated to a specific geometric shape of the magnet (discs, rectangular prisms, rings, spheres, rods) and to an attracting material (steel, other magnet): magnet grade, magnet dimensions, and the distance of the gap between the magnet and the object it is attempting to attract. One of ordinary skill in the art will be able to make these calculations without undue difficulty or experimentation. In some embodiments, the pull force between mover magnets 50 and magnetic object 64 is from about 0.5 to about 4.0 pounds, in other embodiments, about 0.5 to about 3.5 pounds, in other embodiments, about 0.5 to about 2.5 pounds, in other embodiments, about 0.5 to about 2.0 pounds, in other embodiments, about 1.0 to about 5.0 pounds, in other embodiments, about 1.5 to about 5.0 pounds, in other embodiments, about 2.0 to about 5.0 pounds and in other embodiments, about 2.5 to about 3.0 pounds. Here, as well as elsewhere in the specification and claims, individual range values can be combined to form additional non-disclosed ranges.

In one or more embodiments, mover magnets 50 may be N42 grade nickel-plated neodymium disc magnets. In some of these embodiments, mover magnets 50 may be N42 grade neodymium disc magnets and magnetic object 64 is a steel plate and mover magnets 50 will exert an effective pull force on the steel plate through a gap of from about 0.0625 inch to about 0.5 inch of between 0.5 pound and 5 pounds (measures as set forth above), and preferably from about 0.5 pounds to about 3 pounds, in order to prevent the magnetically sensitive cups 38 from falling over while moving or being struck by a thrown ball. In some of these embodiments, the magnetic object 64 is a steel plate, the gap between the mover magnet 50 and the magnetic object 64 is about 0.125 inch, the N42 grade neodymium disc magnets has a diameter of about 0.625 inch and a thicknesses of about 0.1875 inch, and the effective pull force exerted by mover magnet 50 on magnetic object 64 (steel plate) is about 2.17 pounds. In some other of these embodiments, the magnetic object 64 is a steel plate, the gap between the mover magnet 50 and the magnetic object 64 is about 0.125 inch, the N42 grade neodymium disc magnets has a diameter of about 0.75 inch and thicknesses of about 0.125 inch, and the effective pull force exerted by mover magnet 50 on magnetic object 64 (steel plate) is about 1.84 pounds. In some other of these embodiments, the magnetic object 64 is a steel plate, the gap between the mover magnet 50 and the magnetic object 64 is about 0.125 inch, the N42 grade neodymium disc magnets has a diameter of about 0875 inch and thicknesses of about 0.125 inch, and the effective pull force exerted by mover magnet 50 on magnetic object 64 (steel plate) is about 2.41 pounds. In some other of these embodiments, the magnetic object 64 is a steel plate, the gap between the mover magnet 50 and the magnetic object 64 is about 0.25 inch, the N42 grade neodymium disc magnets has a diameter of about 0.75 inch and thicknesses of about 0.1875 inch, and the effective pull force exerted by mover magnet 50 on magnetic object 64 (steel plate) is about 311 pounds. In some other of these embodiments, the magnetic object 64 is a steel plate, the gap between the mover magnet 50 and the magnetic object 64 is about 0.125 inch, the N42 grade neodymium disc magnets has a diameter of about 0.9375 inch and thicknesses of about 0.125 inch, and the effective pull force exerted by mover magnet 50 on magnetic object 64 (steel plate) is about 1.84 pounds.

In some other of these embodiments, the magnetic object 64 is a steel plate, the gap between the mover magnet 50 and the magnetic object 64 is about 0.25 inch, the N42 grade neodymium disc magnets has a diameter of about 0.625 inch and thicknesses of about 0.1875 inch, and the effective pull force exerted by mover magnet 50 on magnetic object 64 (steel plate) is about 0.72 pounds. In some other of these embodiments, the magnetic object 64 is a steel plate, the gap between the mover magnet 50 and the magnetic object 64 is about 0.75 inch, the N42 grade neodymium disc magnets has a diameter of about 0.75 inch and thicknesses of about 0.125 inch, and the effective pull force exerted by mover magnet 50 on magnetic object 64 (steel plate) is about 0.65 pounds. In some other of these embodiments, the magnetic object 64 is a steel plate, the gap between the mover magnet 50 and the magnetic object 64 is about 0.25 inch, the N42 grade neodymium disc magnets has a diameter of about 0.875 inch and thicknesses of about 0.125 inch, and the effective pull force exerted by mover magnet 50 on magnetic object 64 (steel plate) is about 0.92 pounds. In some other of these embodiments, the magnetic object 64 is a steel plate, the gap between the mover magnet 50 and the magnetic object 64 is about 0.25 inch, the N42 grade neodymium disc magnets has a diameter of about 0.75 inch and thicknesses of about 0.1875 inch, and the effective pull force exerted by mover magnet 50 on magnetic object 64 (steel plate) is about 1.14 pounds. In some other of these embodiments, the magnetic object 64 is a steel plate, the gap between the mover magnet 50 and the magnetic object 64 is about 0.25 inch, the N42 grade neodymium disc magnets has a diameter of about 0.9375 inch and thicknesses of about 0.125 inch, and the effective pull force exerted by mover magnet 50 on magnetic object 64 (steel plate) is about 1.07 pounds.

In still other embodiments, the position of mover magnets 50 and magnetic object 64 may be effectively reversed. In these embodiments, a steel plate or other metal attracted to a magnet in mounted on top of mechanisms 48 and moved along the lower surface 40 of low friction game table top 34 in place of mover magnet 50, and magnetic object 64 in magnetically sensitive cups 38 is a magnet of the type described above for use as mover magnet 50.

As will be apparent, there are numerous possible combinations of magnet types, magnet grades, magnet sizes, magnet shapes, gap distances, and low friction game table compositions that will produce an effective pull force on magnetic object 64 that is strong enough to overcome the coefficient of friction between the magnetically sensitive cup 38 and upper surface 36 when mover magnet 50 is put into motion, but not so strong that the added friction created by the stronger pull force inhibits the movement of the magnetically sensitive cup 38 and upper surface 36. One of ordinary skill in the art will be able to select a suitable mover magnet 50/magnetic object 64 combination without undue experimentation.

In other embodiments, magnetic object 64 may be or include a permanent cup magnet and will create additional pull forces between the mover magnets 50 and magnetically sensitive cups 38. As will be apparent, when the one side of mover magnet 50 is facing the side of the cup magnet with opposite magnetic polarity, an attractive pull force is present. In these embodiments also, the attractive pull force through low friction game table top 34 between the mover magnets 50 and the magnetic object 64 (cup magnets) may be from about 0.3 pounds to about 5.0 pounds and is preferably from about 0.5 pounds to 3.0 pounds.

In some of these embodiments, both mover magnets 50 and magnetic object 64 (cup magnets) are a N42 grade neodymium disc magnet having a diameters of about 0.625 inch and thicknesses of 0.125 inch, the gap between them is 0.125 inch, and the effective pull force between them is about 1.96 pounds. In some other of these embodiments, both mover magnets 50 and magnetic object 64 (cup magnets) are a N42 grade neodymium disc magnet having a diameters of about 0.625 inch and thicknesses of 0.125 inch, the gap between them is 0.25 inch, and the effective pull force between them is about 1.96 pounds. In some other of these embodiments, both mover magnets 50 and magnetic object 64 (cup magnets) are a N42 grade neodymium disc magnet having a diameters of about 0.75 inch and thicknesses of 0.125 inch, the gap between them is 0.25 inch, and the effective pull force between them is about 1.10 pounds.

As will be apparent, here are a numerous possible combinations of magnet types, magnet grades, magnet sizes, magnet shapes, gap distances, and low friction game table type compositions that will produce an effective pull force that is strong enough to overcome the coefficient of friction between the cup and the anti-friction surface when put into motion, but is not so strong the added friction created by the stronger pull force inhibits the movement of the magnetically sensitive cup 38 on the upper surface 36 of low friction game table top 38. In some embodiments, the mover magnets and the cup magnets can be identical and in other embodiments, they can differ in grade, shape, size, and strength as long the desired pull force is created.

As set forth above, mover magnets 50 are moved along the lower surface 40 of low friction game table top 34 by magnet moving mechanism 48, which is controlled by microcontroller 100. In various embodiments, the magnet moving mechanism 48 uses one or more electric motors 102 to move the mover magnets 50 along the lower surface 40 of low friction game table top 34 based upon one or more commands received from microcontroller 100. The specific method and mechanisms by which these electric motors 102 may move the mover magnets 50 is not particularly limited and may include, without limitation, belts, pulleys, cogs, chains, pistons, cams, robotic arms, tracks, springs, guide wires, rack gearing, screws, robotic arms, stand-alone motorized vehicles, or combinations thereof.

As set forth above, in various embodiments, magnet moving mechanism 48 comprises one or more electric motors 102. The specific type of electric motor 102 is not particularly limited and any appropriate electric motor may be used. In one or more embodiments, suitable electric motors 102 may include, without limitation, 0.5 volt-5 volts DC electric motors, 1 Volt-24 Volt DC electric motors , NEMA-8 step motors, NEMA-11 step motors, NEMA-14 step motors, NEMA-16 step motors, NEMA-17 step motors, NEMA-23 step motors, NEMA 34 step motors, or NEMA-42 step motors. In one or more embodiments, a 6 Volt Iron-Core Brushed DC electric motor drives the magnet moving mechanism 48. In various embodiments described below, electric motors 102 may be "step" or "stepper motors." Control and operation of step motors is well known in the art and will be described only briefly herein. In these systems, a microcontroller or a programmable logic controller communicates with a Darlington transistor array to send sequences of high or low voltages through two or more wires to the stepper motor. A specific voltage sequence will cause the motor to perform a specific "step" movement. A stepper motor requires an additional DC power supply ranging from 1 volt to 24 volts depending on the size of the motor, and can operate in unipolar or bipolar coil arrangements.

In some embodiments, electric motors 102 may also include a driver 138, which may be separate from or integral with electric motors 102, that is capable of receiving a digital command signal from microcontroller 102 and converting it to a drive voltage that is sent to one or more electric motor 102 causing it to turn in a particular speed or turn a certain number of steps. (See e.g. FIG. 10) In embodiments where a stepper motor is used, driver 138 may be a Darlington transistor array. In some embodiments, driver 138 may be integral with microcontroller 100. In some embodiments, the digital command signal may be sent from microcontroller 100 to driver via a conventional cable for transmitting digital command signals and in other embodiments, the digital command signal may be sent from microcontroller 100 to driver wirelessly, using any suitable wireless protocol, including but not limited to Bluetooth™ radio frequency communication (RFCOMM) protocols, cellular connection, satellite links, radio frequency, infrared signals, wireless networking, microwave communication, WiMAX, WiFi, and ZigBee. In these embodiments, microcontroller 100 and driver 138 (and any other structures described herein as being wirelessly connected to microcontroller 100) will contain the necessary transceivers for sending and receiving the digital signals wirelessly. In various embodiments, electric motors 102 may be servomotors. In other embodiments, electric motors 102 may be step motors.

Unless otherwise specified, the animated game table 30 of the present invention and various portions thereof may use any suitable wireless standards or protocols for wireless communication, including but not limited to: any one of a variety of wireless standards promulgated by institute of Electrical and Electronics Engineers (IEEE) including but not limited, to IEEE 802.11, IEEE 802.15.1, IEEE 802.15.3a, IEEE 802.15.4, IEEE 802.15.5, and IEEE 802.16; wireless personal area networks (WPAN) such as INSTEON™ (Insteon, Irvine, Calif. (2005)), Wireless USB (Wireless USB Promoter Group (2005); WiMedia Alliance (2009)), Bluetooth™ (Bluetooth Special Interest Group), Z-Wave (Z-Wave Alliance), ZigBee (ZigBee Alliance (2003, 2006)), IEEE 802.15.4 Standard); wireless local area networking standards and protocols such as WiFi™ (WiFi Alliance (1999)), IEEE 802.11 Standard), WiMAX (Worldwide interoperability for Microwave Access) (WiMAX Forum; IEEE 802.16), Local Area Networks (LANs); infrared communications standards and protocols (IrDA Protocols)such as those promulgated by Infrared Data Association (IrDA)(1993); cellular and satellite technologies such as those using 3G, 4G, or LTE protocols; active and passive Radio Frequency Identification (RFID) systems; and/or microwave communication systems. One of ordinary skill in the art will be able to select an appropriate wireless protocol for a particular use without undue experimentation.

Figure 6:
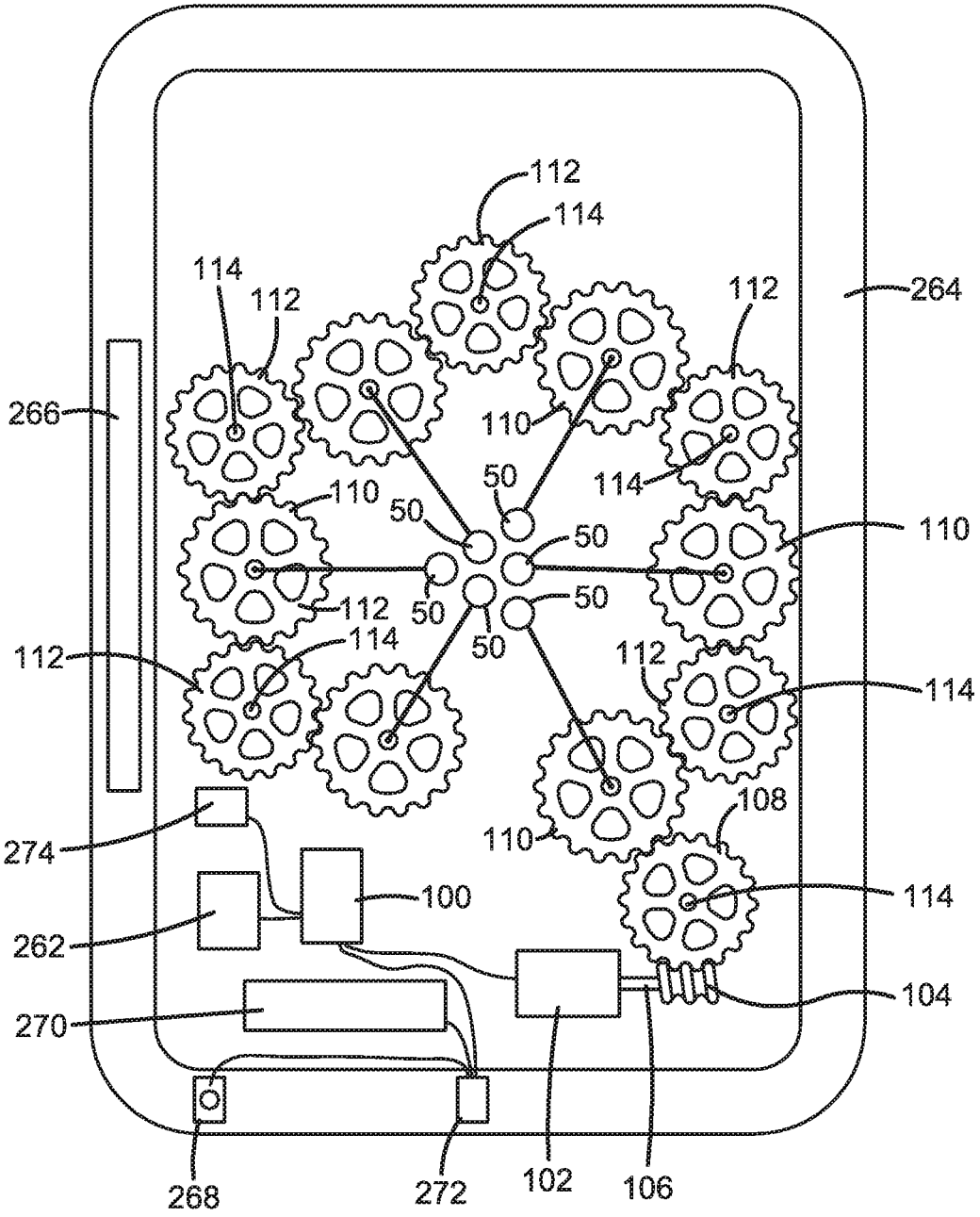
FIG. 6 is a top plan view of an animated game table according to one or more embodiments of the present invention with the low friction game table top removed showing a gear driven belt based mechanism for moving a magnet along the bottom surface of the low friction game table at a first position.
Figure 7:
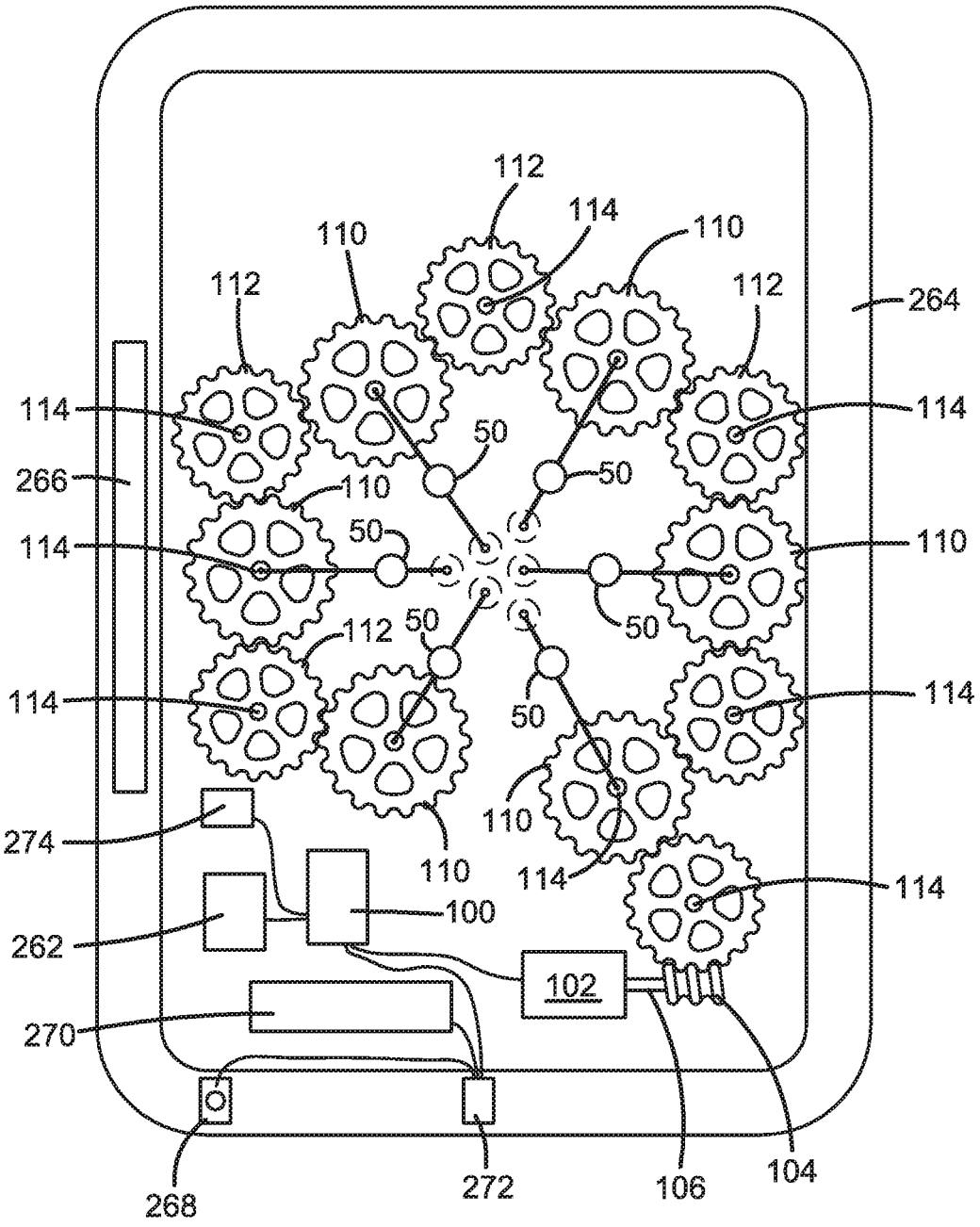
FIG. 7 is a top plan view of an animated game table according to one or more embodiments of the present invention with the low friction game table top removed showing a gear driven belt based mechanism for moving a magnet along the bottom surface of the low friction game table at a second position.

In the embodiment shown in FIGS. 6 and 7, magnet moving mechanism 50 comprises a worm gear 104, turned by drive shaft 106 of electric motor 102 and connected to drive gear 108. As can be seen, drive gear 108 turns a number of magnet drive gears 110 located around the periphery of cavity 90 through a plurality of linking gears 112. Each drive gear 108, magnet drive gear 110, and linking gear 112 are all mounted upon and revolve around a shaft 114, mounted to and extending from the upper surface 42, 82 of base 32. It will be appreciated that there is one magnet drive gear 110 for each mover magnet 50 to be moved and that all of the magnet drive gears 110 are driven by and turn with the electric motor 102 through drive gear 108, linking gears 112 and/or each other.

Figure 8A:
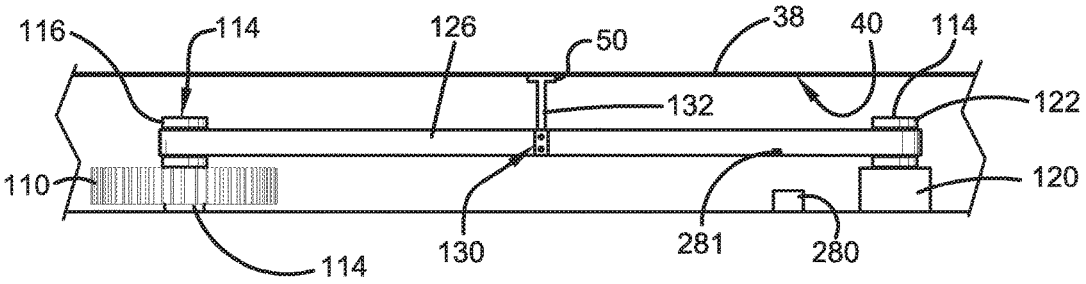
FIGS. 8A-B are partial cross sectional view of a gear driven belt mechanism (FIG. 8A) and a gear driven chain mechanism (FIG. 8B) for moving a magnet along the bottom surface of the low friction game table according to one or more embodiments of the present invention.
Figure 8B:
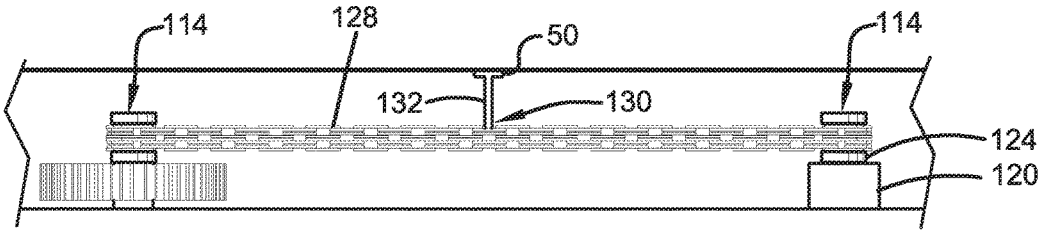
Figure 8C:
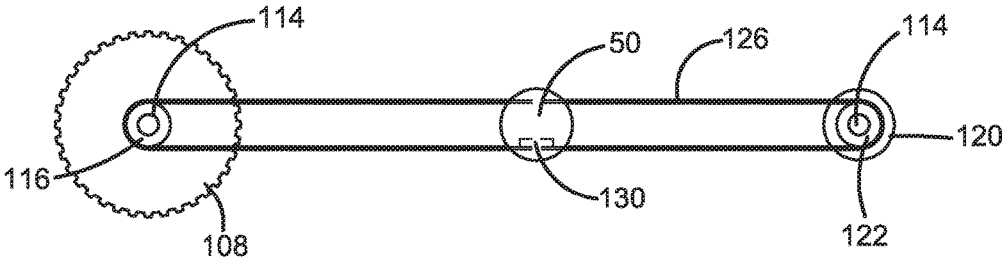
FIG. 8C is a top plan view of a gear driven belt mechanism for moving a magnet along the bottom surface of the low friction game table according to one or more embodiments of the present invention.
Figure 9:
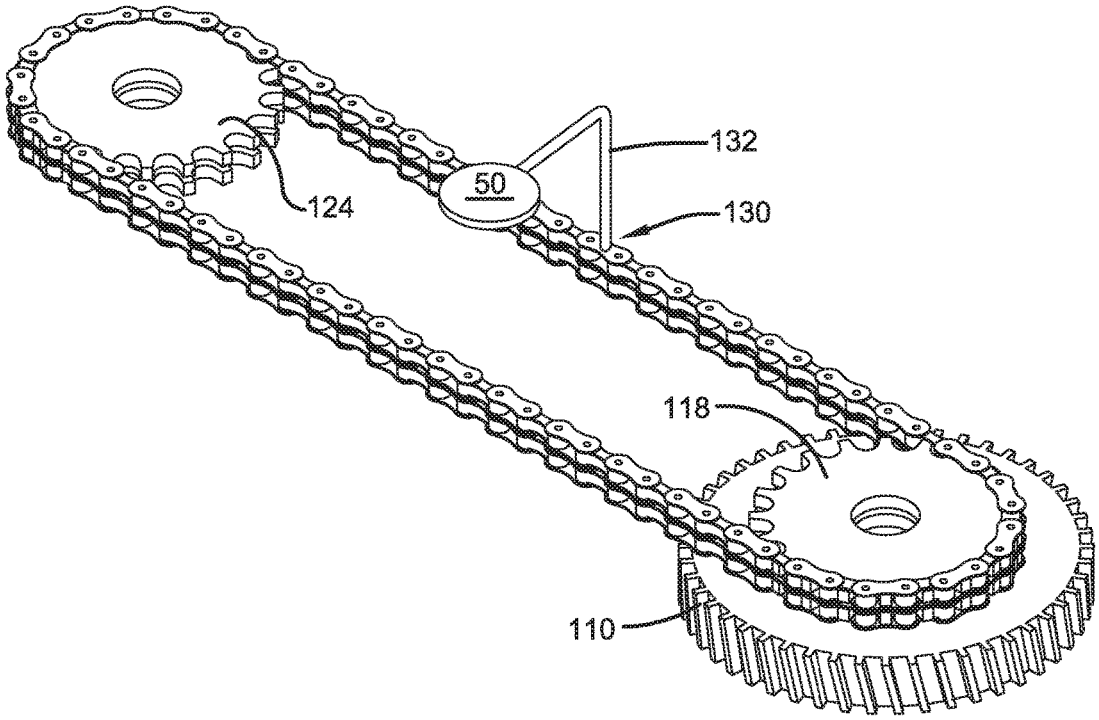
FIG. 9 is a perspective view of a gear driven chain mechanism for moving a magnet along the bottom surface of the low friction game table according to one or more embodiments of the present invention.

As can be seen in FIGS. 8A-C, and 9 centered on a shaft 114 and rotating with each magnet drive gear 110 is a first pulley 116 or cog 118. Placed toward the center of cavity 90 and mounted to and extending, directly or indirectly, through platform 120, from the upper surface 82 of base 32 is another shaft 114, to which is mounted a second pulley 122 or cog 124 as shown in FIGS. 6, 7, 8A-C and/or 9. A belt 126 or chain 128 extends from first pulley 116 or cog 118 to the second pulley 122 or cog 124 and turns with the rotation of the magnet drive gear 110. As will be apparent, belt 126 is ordinarily used with embodiments using pulleys (e.g. first pulley 116 and second pulley 122) and chain 128 is ordinarily used with embodiments using cogs or gears (e.g. first cog 118 and second cog 124). As can be seen in FIGS. 8A-C and/or 9, mover magnets 50 are connected to the belt 126 or chain 128 by magnet bracket 130 having a shaft 132 sized to keep moving magnets 50 in contact or in close proximity with the lower surface 40 of low friction game table top 34 as is moved by magnet moving mechanism 48. As used herein, a mover magnet is in "close proximity" lower surface 40 of low friction game table top 34 when it is in a location substantially adjacent to lower surface 40 and close enough to lower surface 40 that the mover magnet can for a magnetic attraction with a magnetically sensitive cup above it that is of sufficient strength to permit mover magnet to move the cup. Bracket 130 may be secured to the top or side of the belt 126 or chain 128 in any manner that allows the belt 126 or chain 128 to rotate freely around the pulleys 116,122 or cogs 118, 124 and is stable enough keep the mover magnet 50 in place, including, but not limited to, mechanical fasteners, clips, rivets, adhesives, solder, welding, or any combinations thereof. (See FIGS. 8A-C and/or 9.) In some embodiments, shaft 132 may be curved or bent so that mover magnet 50 is slightly offset so that it travels essentially in a straight line between the first pulley 116 or cog 118 and the second pulley 122 or cog 124. (See FIG.9) In addition, it should appreciate that one or more additional pulleys or cogs may be added to the belt 126 or chain 128 to alter the path taken by the mover magnet 50. It should also be appreciated that in some of these embodiments, the speed at which the individual mover magnets travel will depend not only upon the speed of electric motor 102, but also on the relative diameters of the magnet drive gear 110 and first pulley 116 or cog 118.

Figure 10:
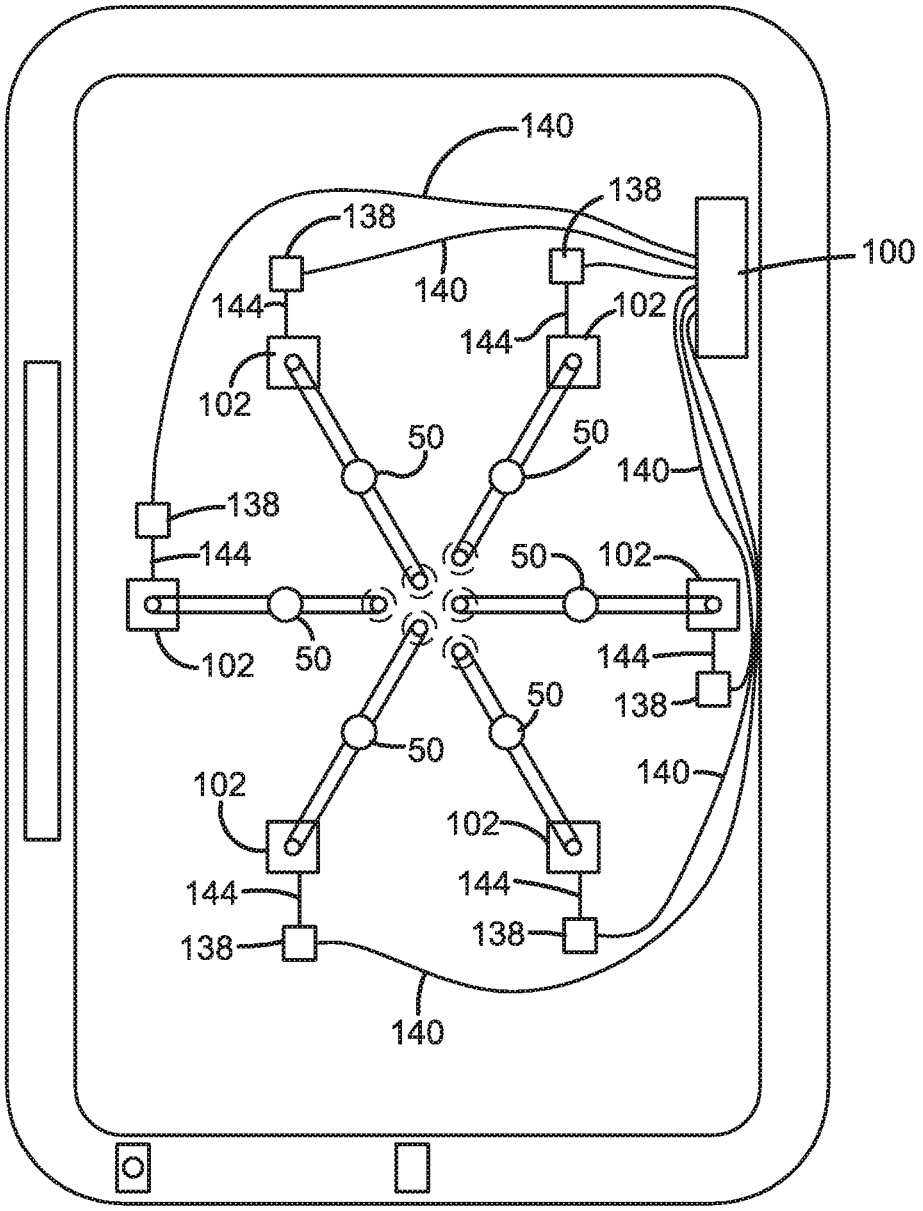
FIG. 10 is a top plan view of an animated game table according to one or more embodiments of the present invention with the low friction game table top removed showing motor driven belt based mechanism for moving a magnet along the bottom surface of the low friction game table.
Figure 11A:
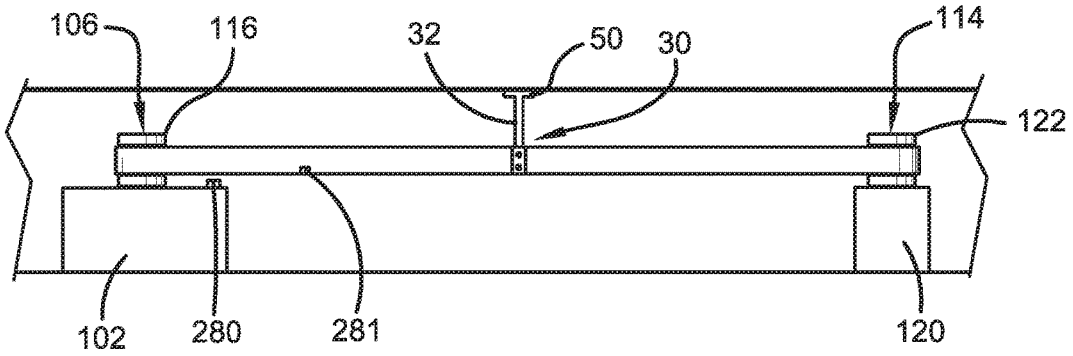
FIGS. 11A-B are partial cross sectional views of a directly driven belt mechanism (FIG. 11A) and a bevel gear driven belt mechanism (FIG. 11B) for moving a magnet along the bottom surface of the low friction game table according to one or more embodiments of the present invention.
Figure 11B:
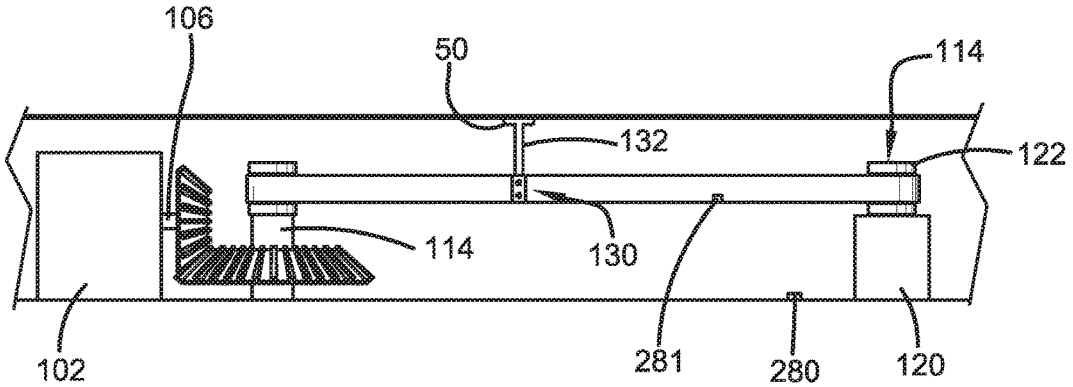

The magnet moving mechanism 48 shown in FIGS. 10 and 11A-B is similar to the gear driven mechanism shown in FIGS. 6, 7, 8A-C and/or 9 and described above, except that the first pulley 116 or cog 118 for each mover magnet mechanism 48 is driven by its own electric motor 102, which is electrically connected to and controlled by microcontroller 100 through data cables 140. In some embodiments, electric motor 102 is directly connected to and communicates directly with microcontroller 102, but in other embodiments electric motor 102 communicates with microcontroller through a data cables 140, motor driver 138 and wires 142. (See FIG. 10). In embodiments such as those shown in FIG. 11A where motor 102 is oriented with drive shaft 106 in a vertical position, first pulley 116 or cog 118 may be mounted directly to drive shaft 106. Where motor 102 is oriented with drive shaft 106 in a horizontal position, first pulley 116 or cog 118 may be turned through a first and second bevel gear 134, 136 as shown in FIG. 11B.

In the embodiment shown in FIGS. 12A-F, magnet moving mechanism 48 further comprises a groove 150 cut into floor 80 base 23 (see FIGS. 12A-B) or a track 152 (see FIGS. 12C-F) in which a trolley 154 carries a mover magnet 50 held in place by magnet bracket 130 having a shaft 132 sized to keep moving magnet 50 in contact with or in close proximity to the lower surface 40 of low friction game table top 34 as trolley 154 is moved along said track 152 or groove 150 by magnet moving mechanism 48. In the embodiments shown in FIGS. 12A-F, trolley 154 moves along groove 150 or track 152 on wheels 156, but this need not be the case and, in other embodiments, any mechanism known in the art that permits trolley to stay within and slide along groove 150 or track 152 may be used. In some of these embodiments, trolley 154 is secured to a belt 126 or chain 128 which is moved as set forth above. (See FIGS. 12A-B, E-F).

Figure 12A:
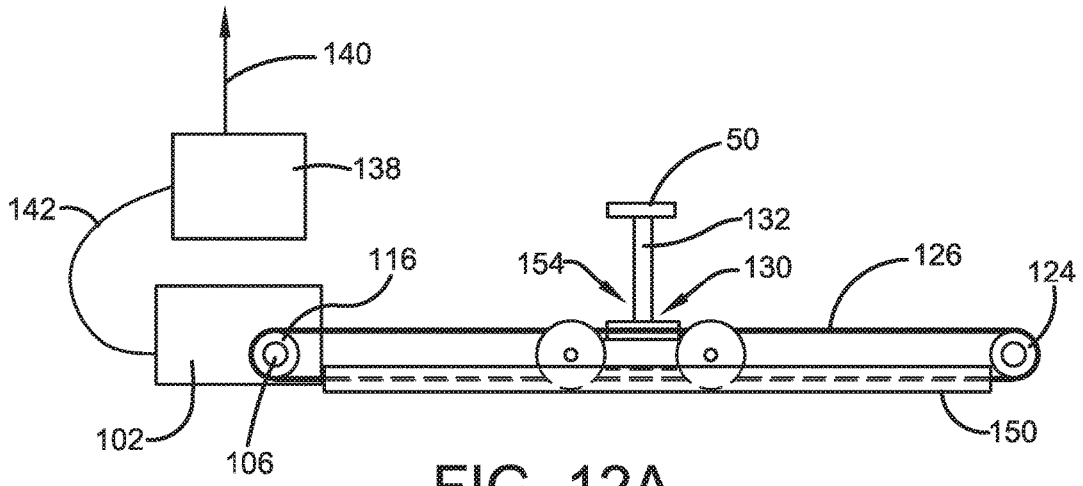
FIG. 12A is a side elevational view of a mechanism for moving a magnet bearing trolley along a groove in the floor of the game base of an animated game table according to one or more embodiments of the present invention.
Figure 12B:
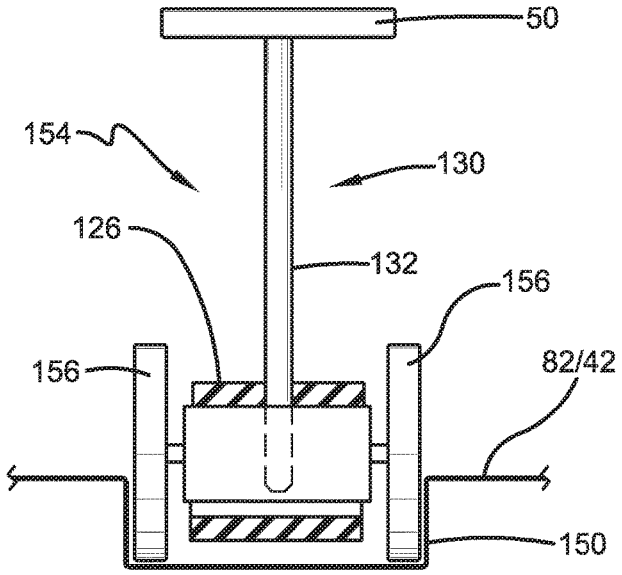
FIG. 12B is a cross sectional view of a magnet bearing trolley and groove in the floor of the game base of an animated game table according to one or more embodiments of the present invention.
Figure 12C:
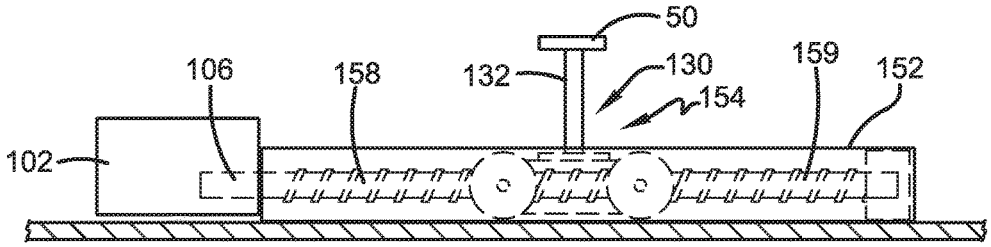
FIGS. 12C is a side view of a screw based mechanism for moving a magnet bearing trolley along a track secured to the floor of the game base of an animated game table according to one or more embodiments of the present invention.
Figure 12D:
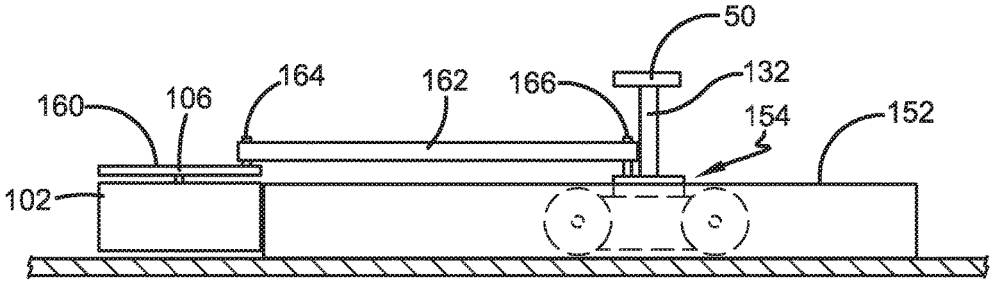
FIGS. 12D is a side view of a cam based mechanism for moving a magnet bearing trolley along a track secured to the floor of the game base of an animated game table according to one or more embodiments of the present invention.
Figure 12E:
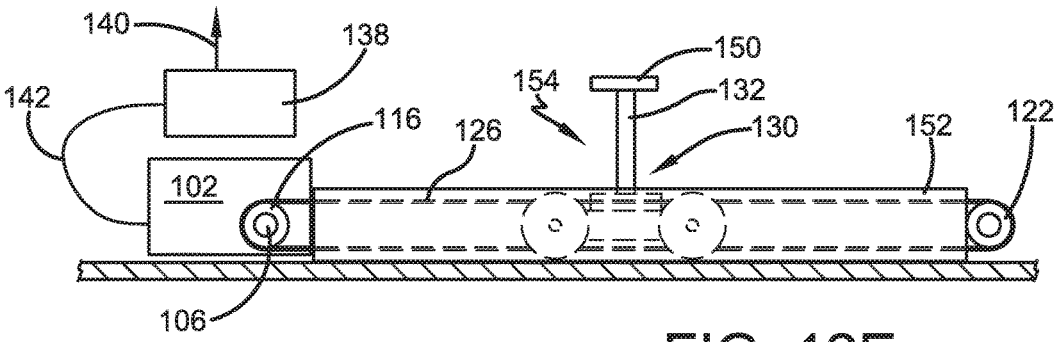
FIGS. 12E is a side view of a belt based mechanism for moving a magnet bearing trolley along a track secured to the floor of the game base of an animated game table according to one or more embodiments of the present invention.
Figure 12F:
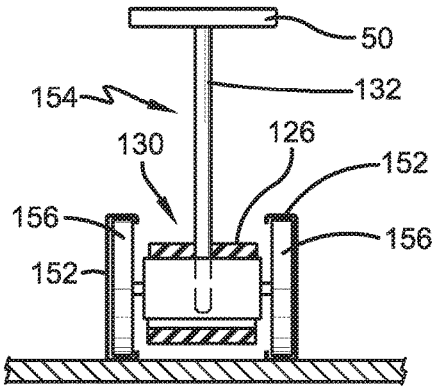
FIGS. 12F is a cross sectional view of a magnet bearing trolley and track secured to the floor of the game base of an animated game table according to one or more embodiments of the present invention.

In some other embodiments, various screw mechanisms may be used. (FIG. 12C). In these embodiments, motor 102 may directly or indirectly turn a long screw running along groove 150 or track 152, running through trolley 154, which in these embodiments has been threaded to receive it. As screw 158 turns, trolley 154 is moved by the screw threads 159 along groove 150 or track 152.

In some other embodiments, various cam mechanisms (FIG. 12D, 13) may be used. In these embodiments, cam 160 is turned by drive shaft 106 of motor 102. A shaft 162 is pivotably attached to a first pivot point 164 located off center on cam 160 and to a second pivot point on trolley 154, as shown, for example, in FIG. 12D. When cam 160 rotates, shaft 162 will pull trolley 154 back and forth along groove 150 or track 152. In another similar embodiment shown in FIG. 13, a round gear 170 having an off center pivot point 172 and a jointed two piece shaft 174 connected to a second pivot point 176 on trolley 154 may be used.

In the embodiments shown in FIG. 14, mover magnet 50 is secured to a rack gear 180 that is free to slide back and forth in a groove 150 or track 152. In these embodiments, motor 102 drives a pinion gear 182 that interfaces with rack gear 180 as shown in FIG. 14. As the pion gear 182 is turned by motor 102, it moves rack gear 180, and with it mover magnet 50 back and forth along a groove 150 or track 152.

In the embodiment shown in FIGS. 15A and 15B, magnet moving mechanism 48 comprises electronically controlled piston mechanism 190, which includes a piston 192 to which a mover magnet 50 held in place by means of magnet bracket 130. Shaft 132 of magnet bracket 130 is again sized to keep mover magnet 50 in contact or in close proximity with the lower surface 40 of low friction game table top 34 as it is moved by the electronically controlled piston mechanism 190. In these embodiments, movement of the electronically controlled piston mechanism 190 is controlled by microcontroller 100. The electronically controlled piston mechanism 190 is preferably a pneumatically operated. Suitable piston mechanisms may include, without limitation, any commercially available electric direct drive linear motor with any stroke length.

Figure 16:
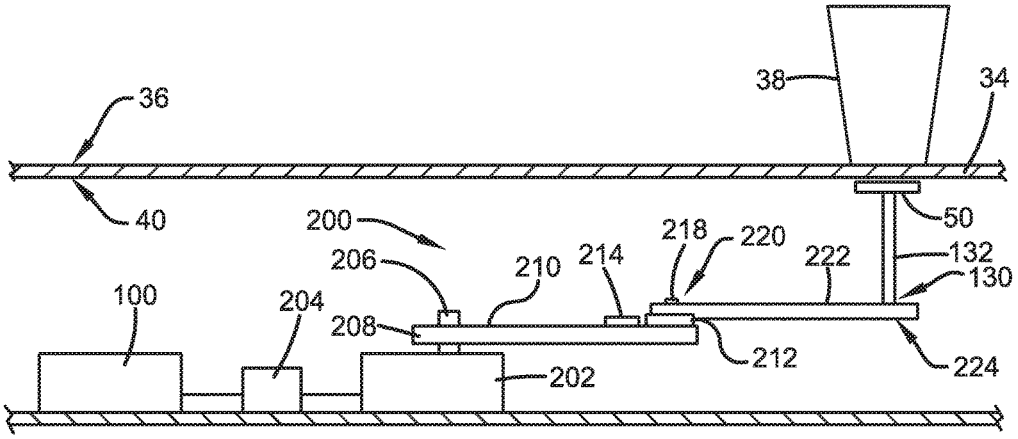
FIG. 16 is a side elevational view of a robotic arm based mechanism for moving a magnet along the bottom surface of the low friction game table according to one or more embodiments of the present invention.

In another embodiment shown in FIG. 16, magnet moving mechanism 48 comprises robotic arm 200. The structure and operation of robotic arm 200 is not particularly limited and any appropriate design known in the art may be used. In various embodiments, robotic arm 200 is controlled by microcontroller 100 and moves a mover magnet 50 along the lower surface 40 of low friction game table top 34. In some of these embodiments, mover magnet 50 is secured to robotic arm by a magnet bracket 130 having a shaft 132 sized to keep moving magnet 50 in contact or in close proximity with the lower surface 40 of low friction game table top 34 as it is moved by the robotic arm.

In one or more embodiments, moving mechanism 48 may comprise the robotic arm mechanism shown in FIG. 17. In the embodiment of FIG. 17, base stepper motor 202 is mounted to the inside surface 82 floor 80 of the game base 32 and is connected to and controlled by a first Darlington transistor array 204 and microcontroller 100. Base stepper motor 202 includes an axel 206, which is connected to a first end 208 of a base arm 210. A secondary stepper motor 212 and a second Darlington transistor array 214 are mounted to a second (opposite) end 216 of the base arm 210. Secondary stepper motor 212 is in communication with second Darlington transistor array 214 and microcontroller 100 and further includes an axel 218, which is connected to a first end 220 of an extension arm 222. In these embodiments, mover magnet 50 is attached to a second end 224 of extension arm 222 by a magnet bracket 130.

In these embodiments, microcontroller 100 communicates to each of the first and second Darlington Transistor Arrays 204, 214 instructing them to send to voltage sequence to base stepper motor 202 and secondary stepper motor 212, respectively, to move the base and extension arms 210, 222 simultaneously or at separate times. As should be apparent, the robotic arm 200 can in this manner move mover magnet 50 over an X and Y-axis plain forwards, backwards, and side to side along the lower surface 40 of low friction game table top 34. Accordingly, in various embodiments, robotic arm 200 can move mover magnet 50 in linear and circular motions or in any angular transition (change of direction).

In some embodiments such as those described above where the mover magnets 50 move in established paths, the mover magnets 50 may be configured to move with grooves 226 cut in the lower surface 40 of low friction game table top 34 as shown in FIG. 17A or within channels 229 formed by ridges 228 formed on or adhered to lower surface 40 of low friction game table top 34 as shown in FIG. 17B.

Figure 18A:
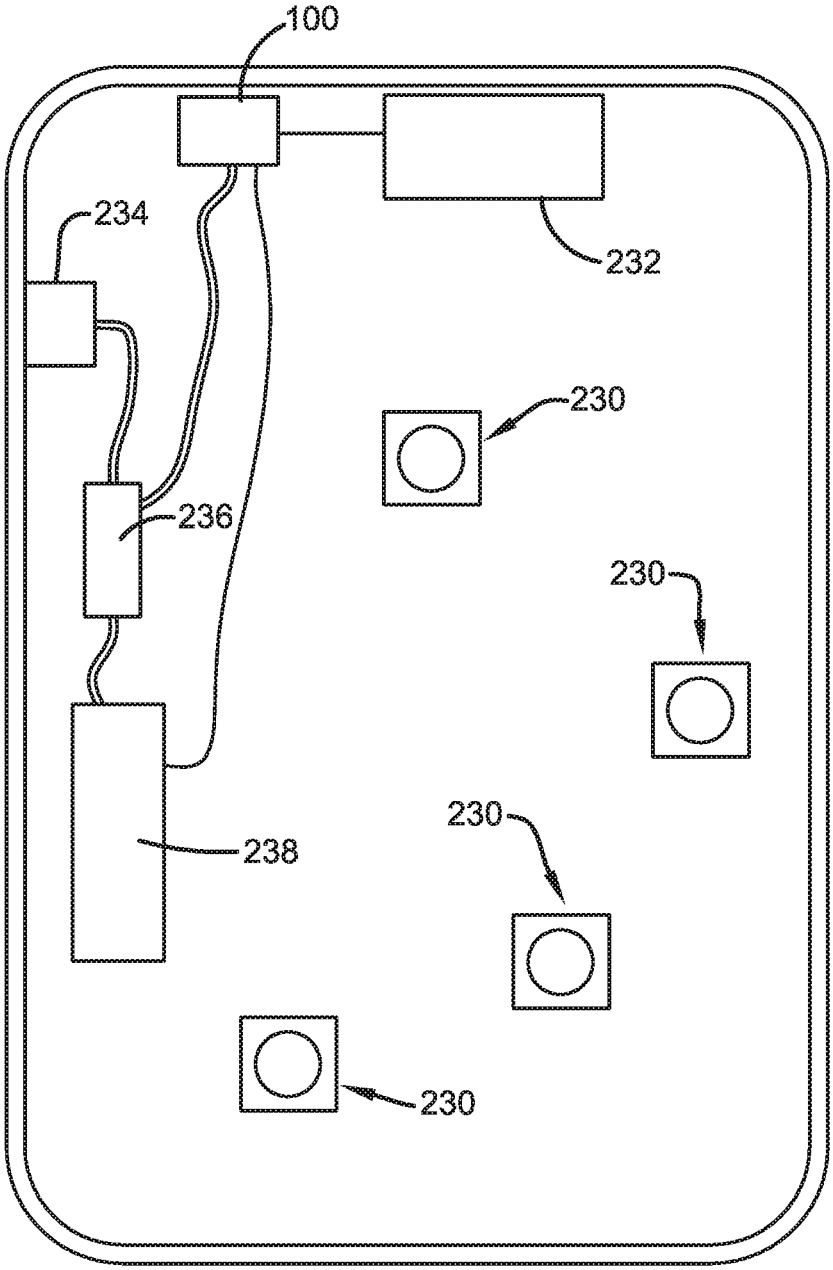
FIGS. 18A-C are schematic diagrams of an stand-alone motorized trolley based mechanism for moving a magnet along the bottom surface of the low friction game table according to one or more embodiments of the present invention providing a top plan view (FIG. 18A) of the stand-alone motorized trolley based mechanism with the low friction game table top removed, a side view (FIG. 18B) of an autonomous trolley of FIG. 18A, and a schematic view (FIG. 18C) of the electronics of the autonomous trolley of FIGS. 18A-B.
Figure 18B:
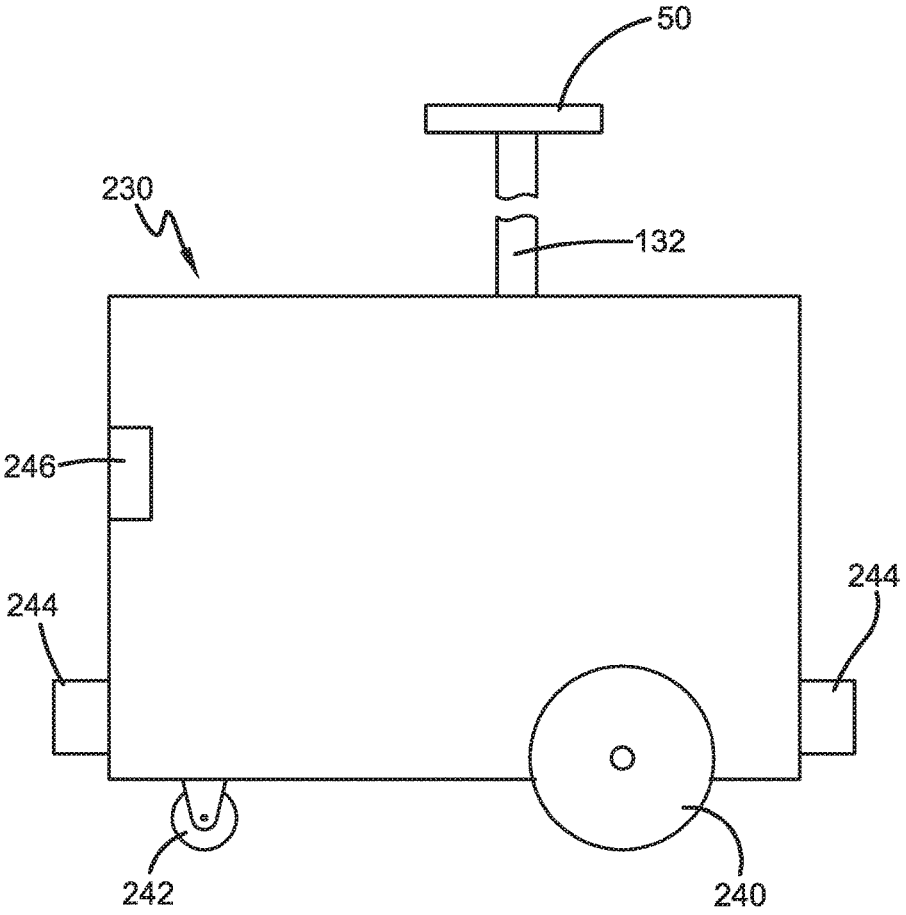
Figure 18C:
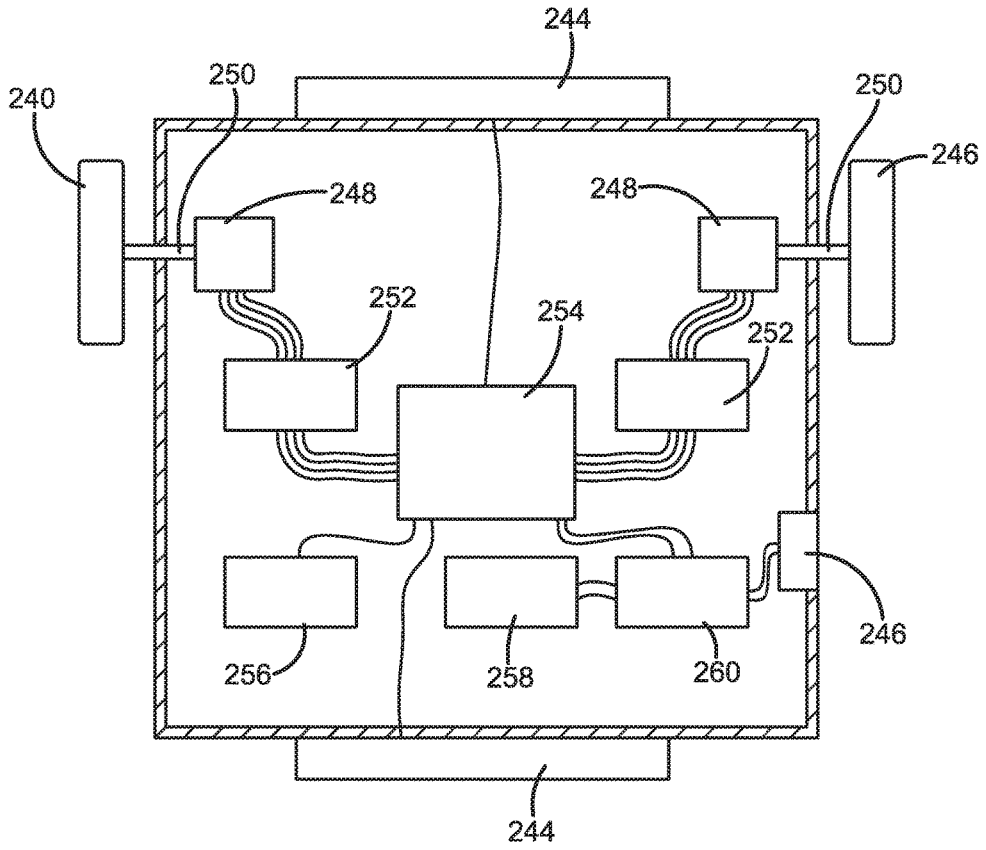

In the embodiment shown in FIGS. 18A-C, magnet moving mechanism 48 comprises a plurality of remotely controlled, stand-alone motorized trollies 230, each moving a mover magnet 50 along the lower surface 40 of low friction game table top 34. The speed, location and direction of travel stand-alone motorized trolleys 230 are all controlled by microcontroller 100. FIG. 18A shows a stand-alone motorized trolley based mechanism according to one or more embodiments of the present invention. As can be seen, arrayed on the floor 82 of the bottom 80 of base 132 are microcontroller 100, Bluetooth™ module 232, charging port 234, rechargeable battery 236, induced magnetism charge generating pad 238, and one or more remotely controlled, stand-alone motorized trollies 230. Rechargeable battery 236 is preferably a lithium ion rechargeable battery, but is not so limited and may be any conventional rechargeable battery. Further, while the embodiment shown in FIGS. 18A-C utilizes Bluetooth™ protocols for wireless communication, the invention is not so limited and any other suitable wireless communication technology and/or protocol may be used and are within the scope of the present invention.

The remotely controlled, stand-alone motorized trollies 230 of one or more embodiments of the present invention are shown in FIGS. 18A and B. As can be seen in FIG. 18B, remotely controlled, mover magnet 50 is secured to the top of stand-alone motorized trolley 230 by magnet bracket 130 so that it moves along the lower surface 40 of low friction game table top 34 as stand-alone motorized trolley 230 moves. In various embodiments, stand-alone motorized trolley 230 has two step motor controlled drive wheels 240, one or more free turning wheels (casters) 242, one or more proximity sensors 244, and a charging port 246.

The control, power, and motion systems of remotely controlled, stand-alone motorized trollies 230 are most clearly shown in FIG. 18C. As can be seen, stepper motors 248 are driven by Darlington transistor arrays 252 to turn axels 250 to turn drive wheels 240 as directed by microcontroller 254 based upon Bluetooth™ signals received from microcontroller 100. As will be apparent, remotely controlled, stand-alone motorized trollies 230 of FIGS. 18A-C use differential steering whereby the two stepper motors 248 move the drive wheels 240 in opposite directions to make sharp turns and move the drive wheels 240 in the same direction at different speeds to perform more gradual turns. In one or more embodiments, drive wheels may be made of rubberized material to provide traction on a plastic surface. The surface of the base's interior floor may be covered with a rubber film to improve the traction of the drive wheels. Suitable material for the rubber film and rubber wheels include, without limitation, Nitrile (NSR), Hydrogenated Nitrile (HNBR), Ethylene-Propylene (EPDM), Fluorocarbon (FKM), Chloroprene (CR), Polyacrylate (ACM), Ethylene Acrylic (AEM), Styrene Butadiene (SBR), Polyurethane (AU/EU), Silicone (VMQ), Fluorosilicone (FVMQ), and Natural Rubber (NR).

In these embodiments, remotely controlled, stand-alone motorized trolley 230 further comprises two or more proximity sensors 244, Bluetooth™ module 256, induced magnetism receiver 258, rechargeable battery 260, and charging port 260. Rechargeable battery 260 is preferably a lithium ion rechargeable battery, but is not so limited and rechargeable battery 260 may be any conventional rechargeable battery. In various embodiments, induced magnetism receiver 258 is composed of one or more iron rods coiled in a wire. This is the secondary coil that receives the electromagnetic current generated from the primary coil (one or more iron rods coiled in a wire) and relays the electrical current to the rechargeable battery. The primary coil is located in the induced magnetism generating pad. The primary coil receives an electrical current from the rechargeable battery located inside of the game base, or from an AC-DC transformer when the game base is plugged into a traditional AC power receptacle to recharge the game base battery. In some of the embodiments, when the trolleys 230 are low on power they will spin in a circle until the proximity sensors 244 detect a marked area inside the base 32 where the induced magnetism charge generating pad 238 is located. Based upon this information, microcontroller 254 will move trolley 230 to this area to recharge its batteries 260 through induced magnetism charging pad 258.

Alternatively, trolleys 230 may be charged via charging port 246. In these embodiments, base 32 must be opened manually and the remotely controlled, each of the stand-alone motorized trollies 230 connected to one or more charging cords manually through charging port 246. The charging cords can extend from the game base's battery, or they can extend from a power converter to be plugged into a traditional wall AC power receptacle.

In the embodiments described above, each mover magnet is moved individually, but the invention is not so limited. In some other embodiments, the various mechanisms for moving 48 described above may be used to move a platform comprising two or more mover magnets, permitting groups of magnetically sensitive cups to be moved together and the platform is moved by mechanism 48 along the lower surface 40 of low friction game table top 34 as described above.

In various embodiments, the animated game table of the present invention further comprises a plurality of audio speakers 262 and flashing and/or colored lights to enhance the game play experience. The audio speakers 262 and lights controlled by microcontroller 100. In various embodiments, speakers 262 produce designated sounds and sound volumes to signal events in the game and game progress. In one or more embodiments, the animated game table of the present invention further comprises a light bar 264 extending around the perimeter of low friction game table top 34. In one or more of these embodiments, light bar 264 comprises a plurality of LED lights. In one or more of these embodiments, light bar 264 comprises one or more strobe lights. In one or more of these embodiments, light bar 264 comprises colored lights and is capable of displaying more than one color. Light bar 264 is controlled by microcontroller 100. In some embodiments, the audio speakers 262 and light bar 264 may be activated by pressing one or more button(s) or a touchscreen located on the game base 32, on a wired remote device, or a wireless remote device. The wireless remote device may use a wireless communication method such as but not limited to, Bluetooth™, cellular connection, satellite link, radio frequency, infrared signals, wireless networking, microwave communication, WiMAX, WiFi, and/or ZigBee. The wireless remote device can be a remote with physical buttons designated to the game base, or it can be in the form of a smart phone or tablet computer.

In various embodiments, the animated game table of the present invention further comprises a display 266 that provides information such as the score, game mode, battery life, and time elapsed. (See FIGS. 6, 7). In one or more embodiment, display 266 may be a touch screen allowing data to be input into microprocessor 100. In one or more embodiments, the touchscreen on display 266 may be used to select one of a group of pre-programmed game modes or select among various pre-programmed sound, light, data storage, networking, and/or cup movement options.

Further, as can be seen in FIGS. 6 and 7, animated game table of the present invention further comprises charge port 268, a rechargeable battery 270, and power switch 272 configured as shown in FIGS, 6 and 7. Charge port 268 is sized to receive a power cord (not shown). In various embodiments, power cord plugs into a standard electrical outlet and provides power through charging port 268 to operate the animated game table of the present invention and/or charge rechargeable battery 270 for later use. Rechargeable battery 270 is preferably a lithium ion rechargeable battery, but is not so limited and may be any conventional rechargeable battery.

As set forth above, movement of magnetically sensitive cups 38 on the animated game table of the present invention is controlled by microcontroller 100. In various embodiments, microcontroller 100 may be programmed to control the mover magnet direction, mover magnet speed, light color, light pattern, light brightness, sound type, sound volume, information to be displayed, and will interpret the commands from the programmed flash memory chip (or other storage device), mini SD, micro SD, or downloaded via Bluetooth™ through Bluetooth™ module 274 or any other suitable wireless platform from a smart device or other computer. As used herein, the term "smart device" is used to refer to a small hand held computer device having significant computing capabilities and a touch screen interface, such as a smart phone or tablet computer. In one or more embodiments, microcontroller 100 will also have its own memory storage system for storing information such as default programs, settings, and game modes. Microcontroller 100 is not particularly limited and may be any microcontroller, programmable logic controller, microprocessor, or computer having sufficient processing, input, output, memory and storage capabilities. One of ordinary skill in the art will be able to select a suitable microcontroller 100 without undue experimentation. In one or more embodiments, suitable microcontrollers 100 may include, without limitation, any commercially available 8-bit or 16-bit microcontrollers.

In some embodiments (see FIGS. 8A, 11A-B), microcontroller 100 may receive data input from one or more sensors 280 that determine whether a mover magnet 50 is at a particular starting location and/or where it is along its path of travel. Sensors 280 are not particularly limited and may, in various embodiments, be any conventional mechanical, electromagnetic, infrared, capacitive, photoelectric or inductive proximity sensor. In some of these embodiments, sensors 280 are stationary and are activated when a marker 281 moves within its sensor range. As will be apparent, sensor 280 provides a signal to microcontroller 100 when mover magnet is at a predetermined starting point.

In various embodiments, microcontroller 100 may be programmed to control the movement of the mover magnets 50 by controlling the speed and direction of each of the motors 102. In some embodiments, microcontroller 100 may send a control signal to each of the electric motors instructing them to return mover magnets 50 to designated starting positions, as indicated by sensors 280 described above. In some other embodiments where a stepper motor us used, microcontroller may instruct the stepper motor to return to an original start position. Alternatively, the game table top may be lifted or removed and mover magnets 50 manually reset to designated starting positions. Given a known starting position, one of ordinary skill in the art will be able to program microcontroller 100 to send control signals to the various electric motors causing them to turn at the necessary speed, direction and/or duration to move the mover magnet along a desired pathway without undue experimentation.

In various embodiments, the microcontroller 100 of the animated game table of the present invention receives data input from a variety of sources. In one or more embodiments, microcontroller 100 may receive data input from one or more sensors (not shown) that determine whether there is a magnetically sensitive cup 38 associated with each or the mover magnets. The proximity or other sensor used to detect whether there is a magnetically sensitive cup 38 associated with a particular mover magnets is not particularly limited and any appropriate sensor capable of detecting the presence of a magnetically sensitive cup 38 with a particular mover magnet 50 may be used. Suitable sensors may include, but are not limited to, conventional mechanical, electromagnetic, infrared, capacitive, photoelectric or inductive proximity sensor. As will be apparent, sensor 282 provides a signal to microcontroller 100 when a magnetically sensitive cup 38 is removed from low friction gave table top 34. The return signal may be sent to microcontroller 100 wirelessly or using a conventional cable, wire or ribbon, depending upon the type of sensor used. One of ordinary skill in the art will be able to select a suitable sensor 282 for detecting the presence of a magnetically sensitive cup 38 without undue experimentation. In some embodiments, microcontroller, 100 can, based upon this information, calculate a game score, which may be broadcast on display 266.

In some embodiments, microcontroller 100 may receive data input from one or more sensors that determine the location and orientation of stand-alone motorized vehicles 230 as described above. In some embodiments, microcontroller 100 may receive data input from a keyboard or touchscreen. Microcontroller 100 may also, in some embodiments, be connected to a card reader allowing data to be read from or copied to a secure digital (SD) card, micro SD card, and/or mini SD card, among others. In some embodiments, microcontroller 100 may also have one or more Universal System Bus (USB) or other data ports through which data may be received and data may be written to a suitable storage device, such as the hard drive of an attached computer or a USB storage device (USB drive).

As set forth above, microcontroller 100 is directly or wirelessly connected to the magnet moving mechanism 48 and directs the movement of the electrical motors 102, and in some embodiments, pneumatic pistons 190, that move the mover magnets 50 and associated magnetically sensitive cups 38. In the embodiment shown in FIGS. 6 and 7, microcontroller 100 further comprises outputs for sending control signals to the, speakers 262, light bar 264 and display 266. In various embodiments, microprocessor 100 may be programmed to control, without limitation, light color, light pattern, light pulse/strobe rate, light brightness, sound type, sound volume, and the information to be displayed on display 266. In one or more embodiment, microcontroller 100 may be programmed to change light bar 264 to certain light colors, pulse/rates, and/or brightness settings, depending on the progress and results of the game. Similarly, in one or more embodiments, microcontroller 100 may be programmed to cause speaker 262 produce designated sounds and sound volumes to signal events in the game and game progress.

In some embodiments, microcontroller 100 may also receive data and control input wirelessly from an external computer device such as a laptop computer, smart phone, or tablet. In various embodiments, microcontroller 100 may also receive data and control input wirelessly using a wireless communication method including, but not limited to, Bluetooth™, cellular connection, satellite link, radio frequency, infrared signals, wireless networking, microwave communication, WiMAX, WiFi, and/or ZigBee. In one or more embodiments, microcontroller 100 is synchronized with an external computer device, such as a laptop computer, smart phone or tablet via a Bluetooth™ connection. In one or more embodiments, an external computer device having a touchscreen input, such as a smart phone or tablet computer may be programmed so that once synchronized with microcontroller 100, movement of the cups can be controlled by a user by manipulating representative circles on the screen of the smart device using their fingers or a stylus.

As set forth above, in some embodiments two or more game units 54 may be used. In these embodiments, the game units 54 may be in Bluetooth™ communication with each other via a Bluetooth™ receiver and a Bluetooth™ signal generator contained in Bluetooth™ module 274 forming a network through which to communicate information such as the start of the game, game type, time elapsed, time limit, game pause, and score. In some other embodiments, two or more game units 54 may be networked using Bluetooth™, cellular connection, satellite link, radio frequency, infrared signals, wireless networking, microwave communication, WiMAX, WiFi, and/or ZigBee. In some embodiments, these linked game units 54 may be further linked to a smart device, allowing the smart device user to control such things as the color, pulse/strobe rate, and brightness of the lights or the sound and volume of the speakers for any of the linked game units 54.

In some other embodiments, one or more of wheels 46 may be connected to one or more electric motors and can be rotated to move base 32 as directed by microcontroller to move base 32 during game play to increase the difficulty and excitement of the game. The movement of the base together with the movement of the interior magnets adds another factor of difficulty of the game.

In light of the foregoing, it should be appreciated that the present invention significantly advances the art by providing an animated game table that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. An animated game table comprising:

a game table top having an upper surface and a lower surface;

one or more cups arranged on the top surface of said game table top, each cup comprising a magnet or ferrous metal; and one or more mover magnets in contact with or in close proximity to the lower surface of said game table top; wherein each of said one or more cups is magnetically attracted to one of said one or more mover magnets, so that movement of said one or more mover magnets along the lower surface of said game table top will cause the cups magnetically attracted thereto to move along the upper surface of said game table top with the movement of said one or more mover magnets;

one or more mechanisms for moving said one or more mover magnets along the lower surface of said game table top, wherein said one or more mechanisms for moving said mover magnets further comprises:

a motor operably connected to a drive gear so that said motor causes said drive gear to turn;

one or more gears operatively connected with said drive gear or each other so that said one or more gears all rotate as the drive gear is turned by the motor;

a first pulley or cog mounted on or engaged with one of said one or more gears so that it rotates with the rotation of said one or more gears;

a second pulley or cog;

a belt or chain running between said first pulley or cog and said second pulley or cog; and a bracket mounted on said belt or chain and connected to one of said mover magnets, said bracket being configured to keep said mover magnet in contact with or in close proximity to the lower surface of said game table top as the belt or chain rotates around said first pulley or cog and said second pulley or cog to move said mover magnet;

and a microprocessor controllably connected to each one of said one or more mechanisms for controlling the movement of said plurality of mover magnets.

2. The animated game table of claim 1 further comprising one or more proximity sensors for determining whether said one or more mover magnets are in a first position.

3. The animated game table of claim 1 further comprising one or more colored lights, flashing lights or speakers, wherein the operation of said one or more colored lights, flashing lights or speakers is controlled by said microprocessor.

4. The animated game table of claim 1 wherein said microprocessor controls the movement of said mover magnets and the operation of said one or more colored lights, flashing lights or speakers based upon instructions stored in memory accessible to said microcontroller or upon instructions received from a smart device.

5. The animated game table system of claim 1 wherein two or more of the animated game tables are networked together and controlled by a smart device.

6. An animated game table comprising:

a game table top having an upper surface and a lower surface;

one or more cups arranged on the top surface of said game table top, each cup comprising a magnet or ferrous metal; and one or more mover magnets in contact with or in close proximity to the lower surface of said game table top; wherein each of said one or more cups is magnetically attracted to one of said one or more mover magnets, so that movement of said one or more mover magnets along the lower surface of said game table top will cause the cups magnetically attracted thereto to move along the upper surface of said game table top with the movement of said one or more mover magnets;

one or more mechanisms for moving said one or more mover magnets along the lower surface of said game table top, wherein said one or more mechanisms for moving said mover magnets comprises:

one or more electric motors each operatively connected to a first pulley or cog so that said first pulley or cog rotates with the rotation of said electric motor;

a second pulley or cog;

a belt or chain running between said first pulley or cog and said second pulley or cog; and a bracket mounted on said belt or chain and connected to one of said mover magnets, said bracket being configured to keep said mover magnet in contact with or in close proximity to the lower surface of said game table top as the belt or chain rotates around said first pulley or cog and said second pulley or cog to move said mover magnet and a microprocessor controllably connected to each one of said one or more mechanisms for controlling the movement of said plurality of mover magnets.

7. The animated game table of claim 6 further comprising one or more proximity sensors for determining whether said one or more mover magnets are in a first position.

8. The animated game table of claim 6 further comprising one or more colored lights, flashing lights or speakers, wherein the operation of said one or more colored lights, flashing lights or speakers is controlled by said microprocessor.

9. The animated game table of claim 6 wherein said microprocessor controls the movement of said mover magnets and the operation of said one or more colored lights, flashing lights or speakers based upon instructions stored in memory accessible to said microcontroller or upon instructions received from a smart device.

10. The animated game table system of claim 6 wherein two or more of the animated game tables are networked together and controlled by a smart device.

11. An animated game table comprising:

a game table top having an upper surface and a lower surface;

one or more cups arranged on the top surface of said game table top, each cup comprising a magnet or ferrous metal; and one or more mover magnets in contact with or in close proximity to the lower surface of said game table top;

wherein each of said one or more cups is magnetically attracted to one of said one or more mover magnets, so that movement of said one or more mover magnets along the lower surface of said game table top will cause the cups magnetically attracted thereto to move along the upper surface of said game table top with the movement of said one or more mover magnets;

one or more mechanisms for moving said one or more mover magnets along the lower surface of said game table top, wherein said one or more mechanisms for moving said mover magnets further comprises:

a lower surface located below and separated from said game table top a track located on said lower surface;

a trolley configured to move along said track;

a bracket mounted on said trolley configured to keep said mover magnet in contact with or in close proximity to the lower surface of said game table top as the trolley moves along said track; and a motor for moving said trolley back and forth along said track;

and a microprocessor controllably connected to each one of said one or more mechanisms for controlling the movement of said plurality of mover magnets.

12. The animated game table of claim 11 wherein said motor moves said trolley back and forth along said track by means of a pulley, a chain, a cam, a screw, or a piston.

13. The animated game table of claim 11 further comprising one or more proximity sensors for determining whether said one or more mover magnets are in a first position.

14. The animated game table of claim 11 further comprising one or more colored lights, flashing lights or speakers, wherein the operation of said one or more colored lights, flashing lights or speakers is controlled by said microprocessor.

15. The animated game table of claim 11 wherein said microprocessor controls the movement of said mover magnets and the operation of said one or more colored lights, flashing lights or speakers based upon instructions stored in memory accessible to said microcontroller or upon instructions received from a smart device.

16. The animated game table system of claim 11 wherein two or more of the animated game tables are networked together and controlled by a smart device.

17. An animated game table comprising:

a game table top having an upper surface and a lower surface;

one or more cups arranged on the top surface of said game table top, each cup comprising a magnet or ferrous metal; and one or more mover magnets in contact with or in close proximity to the lower surface of said game table top; wherein each of said one or more cups is magnetically attracted to one of said one or more mover magnets, so that movement of said one or more mover magnets along the lower surface of said game table top will cause the cups magnetically attracted thereto to move along the upper surface of said game table top with the movement of said one or more mover magnets;

one or more mechanisms for moving said one or more mover magnets along the lower surface of said game table top, wherein said one or more mechanisms for moving said mover magnets further comprises:

a wirelessly controlled motorized trolley, wherein the movement of said wirelessly controlled motorized trolley is controlled by a microcontroller; and a bracket mounted on said trolley configured to keep said mover magnet in contact with or in close proximity to the lower surface of said game table top as the trolley moves along said track.

18. The animated game table of claim 17, said animated game table further comprising a induced magnetism charge generating pad connected to a power source and said trolley further comprises an induced magnetism charger connected to a rechargeable battery, wherein the rechargeable battery of said trolley can be charged by placing said trolley on said induced magnetism charge generating pad.

19. The animated game table of claim 18 wherein each trolley further comprises one or more proximity sensors for determining the location of said induced magnetism charge generating pad.

20. The animated game table of claim 17 further comprising one or more proximity sensors for determining whether said one or more mover magnets are in a first position.

21. The animated game table of claim 17 further comprising one or more colored lights, flashing lights or speakers, wherein the operation of said one or more colored lights, flashing lights or speakers is controlled by said microprocessor.

22. The animated game table of claim 17 wherein said microprocessor controls the movement of said mover magnets and the operation of said one or more colored lights, flashing lights or speakers based upon instructions stored in memory accessible to said microcontroller or upon instructions received from a smart device.

23. The animated game table system of claim 17 wherein two or more of the animated game tables are networked together and controlled by a smart device.

* * * * *